US011592218B2

(12) United States Patent
Ilercil

(10) Patent No.: US 11,592,218 B2
(45) **Date of Patent: *Feb. 28, 2023**

(54) PORTABLE ACTIVE TEMPERATURE CONTROLLED CONTAINER COMPRISING A COOL SINK

(71) Applicant: AMBASSADOR ASSET MANAGEMENT LIMITED PARTNERSHIP, Mesa, AZ (US)

(72) Inventor: Alp Ilercil, Scottsdalle, AZ (US)

(73) Assignee: Ambassador Asset Management Limited Partnership, Mesa, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/233,419

(22) Filed: Apr. 16, 2021

(65) Prior Publication Data

US 2021/0341184 A1 Nov. 4, 2021

Related U.S. Application Data

(63) Continuation of application No. 14/820,527, filed on Aug. 6, 2015, now Pat. No. 10,982,883.

(60) Provisional application No. 62/034,102, filed on Aug. 6, 2014.

(51) Int. Cl.
*F25B 21/02* (2006.01)

(52) U.S. Cl.
CPC ..... *F25B 21/02* (2013.01)

(58) Field of Classification Search
CPC .... F25B 21/02; F25B 21/04; F25B 2339/021; F25B 2400/11; F25B 2321/02; F25B 2321/023; B60H 3/0092
See application file for complete search history.

(56) References Cited

U.S. PATENT DOCUMENTS 6,467,275 B1 * 10/2002 Ghoshal ..... H01L 35/10 136/204
2009/0277187 A1 * 11/2009 McGann ..... F25B 27/002 62/235.1
2017/0211854 A1 * 7/2017 Crocco ..... B01L 7/52

* cited by examiner

*Primary Examiner* — David J Teitelbaum
(74) *Attorney, Agent, or Firm* — Rodney J. Fuller; Booth Udall Fuller, PLC

(57) ABSTRACT

An active temperature controlled container is configured to be portable so as to safely transport temperature sensitive and perishable goods (such as biological material): within a vessel that is thermally coupled to a thermoelectric assembly disposed within the container, where the thermal engine is powered by a power source, such as a battery. The thermoelectric assembly may include one or more resistors coupled to a resistor spacer block to act as a cool sink by actively and passively increasing the efficiency of the thermoelectric assembly.

20 Claims, 15 Drawing Sheets

40 x 40 mm, 127 couples 1 Layer of Thermoelectric modules Thermaly and Electrically in Series with 3.3 Ohm Resisto 0.0 C Delta T

| Layer | Cold side | Hot side | Delta T | TE Voltage | R Voltage | Q add | Power | COP |
|---|---|---|---|---|---|---|---|---|
| 1.4 Ohm TE - 3.3 Ohm resistor | 25.0 | 25.0 | 0.0 | 1.4900 | 3.510 | 16.58 | 5.30 | 3.1283 |

Cool Sink Specifications

| | |
|---|---|
| Resistor Capacitance Spacer | 0.75 inch |
| Layers | 1 |
| Electrical configuration | Series |
| Total Supplied voltage { Volt } | 5.00 |
| Total Measured Current { Amp } | 1.06 |
| Total Supplied Power { W } | 5.30 |

Thermolectric Module Specifications

| | | |
|---|---|---|
| Size { mm } | 40 x 40 | |
| Number of Couples | 127 | |
| Power { Q max } Delta T =0 { Watts } | 243.48 | Hot side |
| Delta T Max @ Qc =0 { Celcius } | 65.83 | |
| V max { Volts } | 15.3 | |
| I max { Amperes } | 10.62 | |
| Resistor | 3.3 Ohm TO 247 package | |

FIG. 6A 40 x 40 mm, 127 couples 1 Layer of Thermoelectric modules Thermaly and Electrically in Series with 3.3 Ohm Resisto 1.0 C Delta T

| Layer | Cold side | Hot side | Delta T | TE Voltage | R Voltage | Q add | Power | COP |
|---|---|---|---|---|---|---|---|---|
| 1.4 Ohm TE - 3.3 Ohm resistor | 37.5 | 38.5 | 1.0 | 1.5100 | 3.490 | 15.36 | 5.25 | 2.9257 |

Cool Sink Specifications

| | |
|---|---|
| Resistor Capacitance Spacer | 0.75 inch |
| Layers | 1 |
| Electrical configuration | Series |
| Total Supplied voltage ( Volt ) | 5.00 |
| Total Measured Current ( Amp ) | 1.05 |
| Total Supplied Power ( W ) | 5.25 |

Thermolectric Module Specifications

| | | |
|---|---|---|
| Size ( mm ) | 40 x 40 | |
| Number of Couples | 127 | |
| Power ( Q max ) Delta T =0 ( Watts ) | 243.48 | Hot side |
| Delta T Max @ Qc =0 ( Celcius ) | 65.83 | |
| V max ( Volts ) | 15.3 | |
| I max ( Amperes ) | 10.62 | |
| Resistor | 3.3 Ohm TO 247 package | |

FIG. 6B 40 x 40 mm, 127 couples 1 Layer of Thermoelectric modules Thermaly and Electrically in Series with 3.3 Ohm Resisto 5 C Delta T

| Layer | Cold side | Hot side | Delta T | TE Voltage | R Voltage | Q add | Power | COP |
|---|---|---|---|---|---|---|---|---|
| 1.4 Ohm TE - 3.3 Ohm resistor | 33.5 | 38.5 | 5.0 | 1.6500 | 3.350 | 11.76 | 4.90 | 2.4000 |

Cool Sink Specifications

| | |
|---|---|
| Resistor Capacitance Spacer | 0.75 inch |
| Layers | 1 |
| Electrical configuration | Series |
| Total Supplied voltage ( Volt ) | 5.00 |
| Total Measured Current ( Amp ) | 0.98 |
| Total Supplied Power ( W ) | 4.90 |

Thermolectric Module Specifications

| | | |
|---|---|---|
| Size ( mm ) | 40 x 40 | |
| Number of Couples | 127 | |
| Power ( Q max ) Delta T =0 ( Watts ) | 243.48 | Hot side |
| Delta T Max @ Qc =0 ( Celcius ) | 65.83 | |
| V max ( Volts ) | 15.3 | |
| I max ( Amperes ) | 10.62 | |
| Resistor | 3.3 Ohm TO 247 package | |

FIG. 6C 40 x 40 mm, 127 couples 1 Layer of Thermoelectric modules Thermaly and Electrically in Series with 3.3 Ohm Resisto 11.8 C Delta T

| Layer | Cold side | Hot side | Delta T | TE Voltage | R Voltage | Q add | Power | COP |
|---|---|---|---|---|---|---|---|---|
| 1.4 Ohm TE - 3.3 Ohm resistor | 25.3 | 37.1 | 11.8 | 1.9400 | 3.050 | 6.21 | 4.49 | 1.3828 |

Cool Sink Specifications

| | | |
|---|---|---|
| Resistor Capacitance Spacer | 0.75 inch | |
| Layers | 1 | |
| Electrical configuration | Series | |
| Total Supplied voltage { Volt } | 4.99 | |
| Total Measured Current { Amp } | 0.90 | |
| Total Supplied Power { W } | 4.49 | |

Thermolectric Module Specifications

| | | |
|---|---|---|
| Size { mm } | 40 x 40 | |
| Number of Couples | 127 | |
| Power { Q max } Delta T =0 { Watts } | 243.48 | Hot side |
| Delta T Max @ Qc =0 { Celcius } | 65.83 | |
| V max { Volts } | 15.3 | |
| I max { Amperes } | 10.62 | |
| Resistor | 3.3 Ohm TO 247 package | |

FIG. 6D

PORTABLE ACTIVE TEMPERATURE CONTROLLED CONTAINER COMPRISING A COOL SINK

RELATED APPLICATIONS

This application is a continuation of U.S. patent application Ser. No. 14/820,527, filed Aug. 6, 2015, which claims the benefit of U.S. Provisional Patent Application No. 62/034,102, filed Aug. 6, 2014 titled "Portable Active Temperature Controlled Container Comprising a Cool Sink," the contents of each of which are hereby incorporated by reference in their entireties.

TECHNICAL FIELD

The present disclosure relates to active temperature controlled containers for shipping and transport of temperature sensitive goods. The active temperature controlled containers disclosed herein can be employed wherever a conventional active temperature controlled container is used with additional benefits as described herein.

BACKGROUND

Active temperature controlled containers can comprise a number of thermocouples to actively apply the Peltier effect to advantageously transport heat within an iso-thermal transport system. The Peltier effect is the presence of heating or cooling at an electrified junction of two different conductors. The Peltier effect has been advantageously used in harnessing thermoelectric effects whereby temperature differences are directly converted to electric voltages, and vice versa. Accordingly, a thermoelectric heat pump is built to include a plurality of thermocouples that include a junction of two different conductors that are electrified at the junction to create heating or cooling, according to the temperature sensitive cargo disposed within the iso-thermal transport and storage system. Examples of temperature sensitive cargo that can benefit from transport in iso-thermoelectric heat pump and storage systems include biological materials and samples, including cell and tissue cultures, nucleic acids, bodily fluids, tissues, organs, embryos, plant tissues, and other sensitive goods such as pharmaceuticals, vaccines and chemicals. Various systems for temperature regulation for transported materials requiring a stable thermal environment are known. Iso-thermal transport systems seek to be robust, efficient, and self-sufficient for safely storing and maintaining cargo during transport, storage, or both.

Improved active temperature controlled containers are needed to allow for improved cool sinks that can increase the temperature of temperature sensitive cargo with respect to the ambient temperature. Improved cool sinks can enhance the operation and transportability of active temperature controlled containers.

SUMMARY

A need exists for portable transportable active temperature controlled containers and methods for providing the same. Accordingly, in an aspect, a portable transportable active temperature controlled container can comprise a vessel for holding temperature sensitive goods, a thermoelectric assembly comprising at least one thermoelectric unit layer coupled to the vessel, a thermally conductive resistor spacer block coupled to the thermoelectric assembly opposite the vessel, and at least one resistor coupled to the resistor spacer block.

In some aspects, the at least one resistor of the portable transportable active temperature controlled container can further comprise being electrically coupled in series to the thermoelectric assembly. In certain aspects, the at least one resistor is disposed within a recess formed in the resistor spacer block.

In another aspect, a portable transportable active temperature controlled container can comprise the temperature differential between a temperature of a cold side and a hot side of the thermoelectric assembly is less than or equal to 13° C. In some aspects, the thermoelectric assembly is adapted to control a temperature of the temperature-sensitive goods within the vessel to within plus or minus 0.3° C. of a target temperature of 38.5° C.

The portable transportable active temperature controlled container can further comprise a resistance of the thermoelectric assembly being in a range of 0.35-0.65 times a resistance of the at least one resistor. The portable transportable active temperature controlled container can further comprise a resistance of the thermoelectric assembly being in a range of 0.25-0.50 times a resistance of the at least one resistor.

In another aspect, the portable transportable active temperature controlled container and the thermoelectric assembly can further be configured to operate with a coefficient of performance greater than or equal to 100%, and/or operate with a coefficient of performance in a range of 150-300% during at least 80 percent of operation.

In another aspect, a portable transportable active temperature controlled container is formed without a fan and/or is formed without a vent between the thermoelectric assembly and an exterior of the portable active temperature controlled container.

In some aspects, a portable transportable active temperature controlled container can comprise a vessel for holding temperature sensitive goods, a thermoelectric assembly comprising at least one thermoelectric unit layer coupled to the vessel, the thermoelectric assembly being configured to operate with a coefficient of performance greater than or equal to 100%, a thermally conductive resistor spacer block coupled to the thermoelectric assembly opposite the vessel, and at least one resistor coupled to the resistor spacer block.

The portable transportable active temperature controlled container and the thermoelectric assembly can further be configured so that the at least one thermoelectric unit layer is adapted to active use of the Peltier effect. In some aspects, the temperature sensitive goods comprise: embryos, oocytes, cell cultures, tissue cultures, chondrocytes, nucleic acids, bodily fluids, bovine semen, organs, plant tissues, pharmaceuticals, vaccines, and chemicals. In certain aspects, the resistor spacer block comprises aluminum, aluminum alloy, copper, or copper alloy and conducts heat generated by the at least one resistor towards a cold side of the at least one thermoelectric unit layer.

In some aspects, a portable transportable active temperature controlled container can comprise a vessel for holding temperature sensitive goods, a thermoelectric assembly comprising at least one thermoelectric unit layer coupled to the vessel, a thermally conductive resistor spacer block coupled to the thermoelectric assembly opposite the vessel, and at least one resistor coupled to the resistor spacer block, wherein a resistance of the thermoelectric assembly is in a range of 0.35-0.65 times a resistance of the at least one resistor.

The portable transportable active temperature controlled container can further be configured so that: the temperature differential between a temperature of a cold side and a hot side of the thermoelectric assembly is less than or equal to 13° C.; the at least one resistor is electrically coupled in series to the thermoelectric assembly; the at least one resistor is disposed within a recess formed in the resistor spacer block; and/or the portable active temperature controlled container is formed without a fan.

BRIEF DESCRIPTION OF THE DRAWINGS

FIGS. 6A-6D show charts, each of which illustrates how various embodiments maximize efficiency of operation compared to previously available thermoelectric heat pump systems; the charts further illustrate how various embodiments can be configured to maximize heat pumped per unit of input power during overall use, while minimizing the ration of input current to maximum available current at a given steady-state temperature, according to embodiments disclosed in accordance with FIGS. 1A and 1B.

DETAILED DESCRIPTION

Figure 1A:
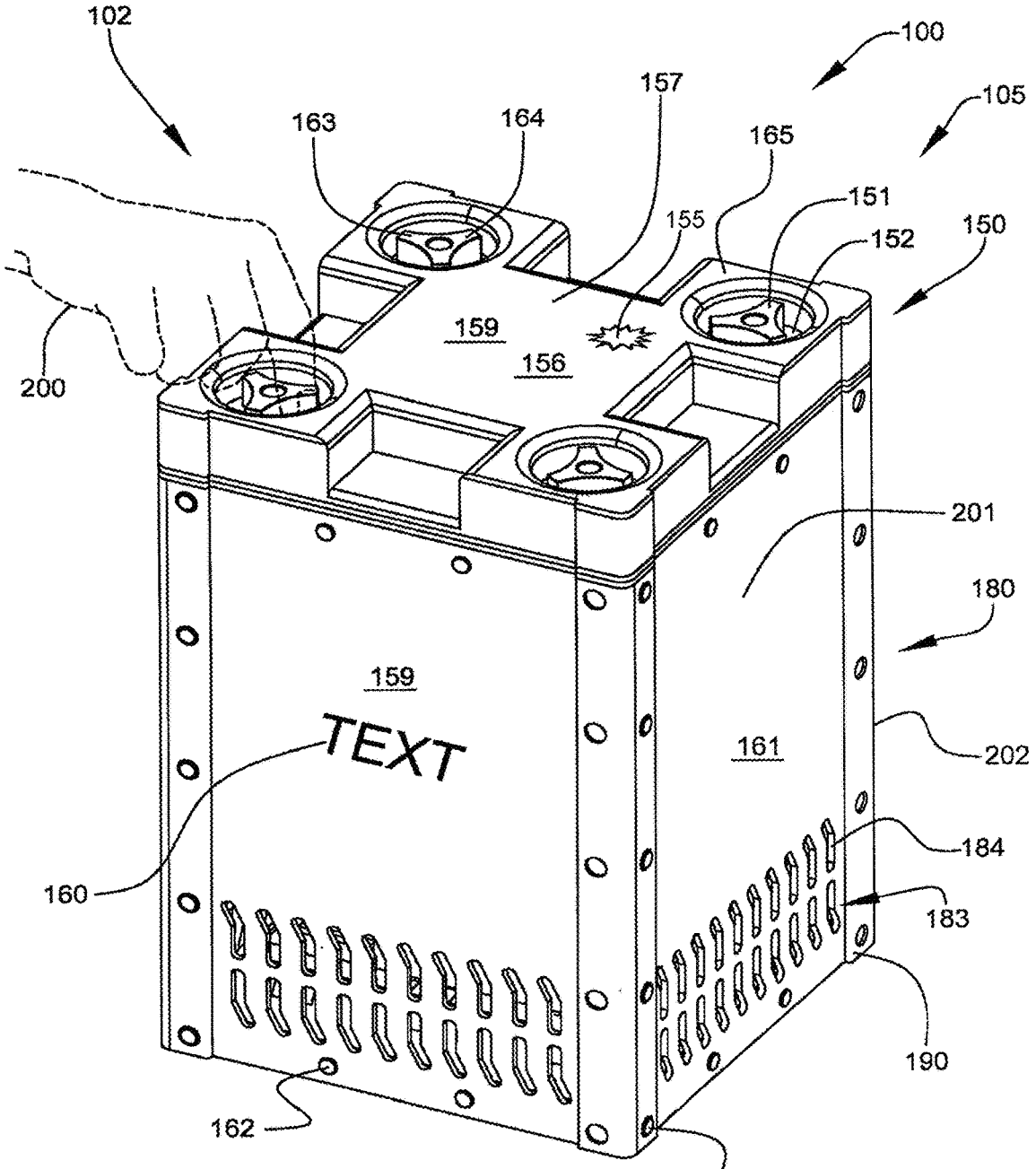
FIGS. 1A and 1B show perspective views, illustrating various embodiments of the active temperature controlled container.

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The words "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes embodiments of many different forms, there is shown in the drawings and will herein be described in detail particular embodiments with the understanding that the present disclosure is to be considered as an exemplification of the principles of the disclosed methods and systems, and is not intended to limit the broad aspect of the disclosed concepts to the embodiments illustrated.

Figure 1B:
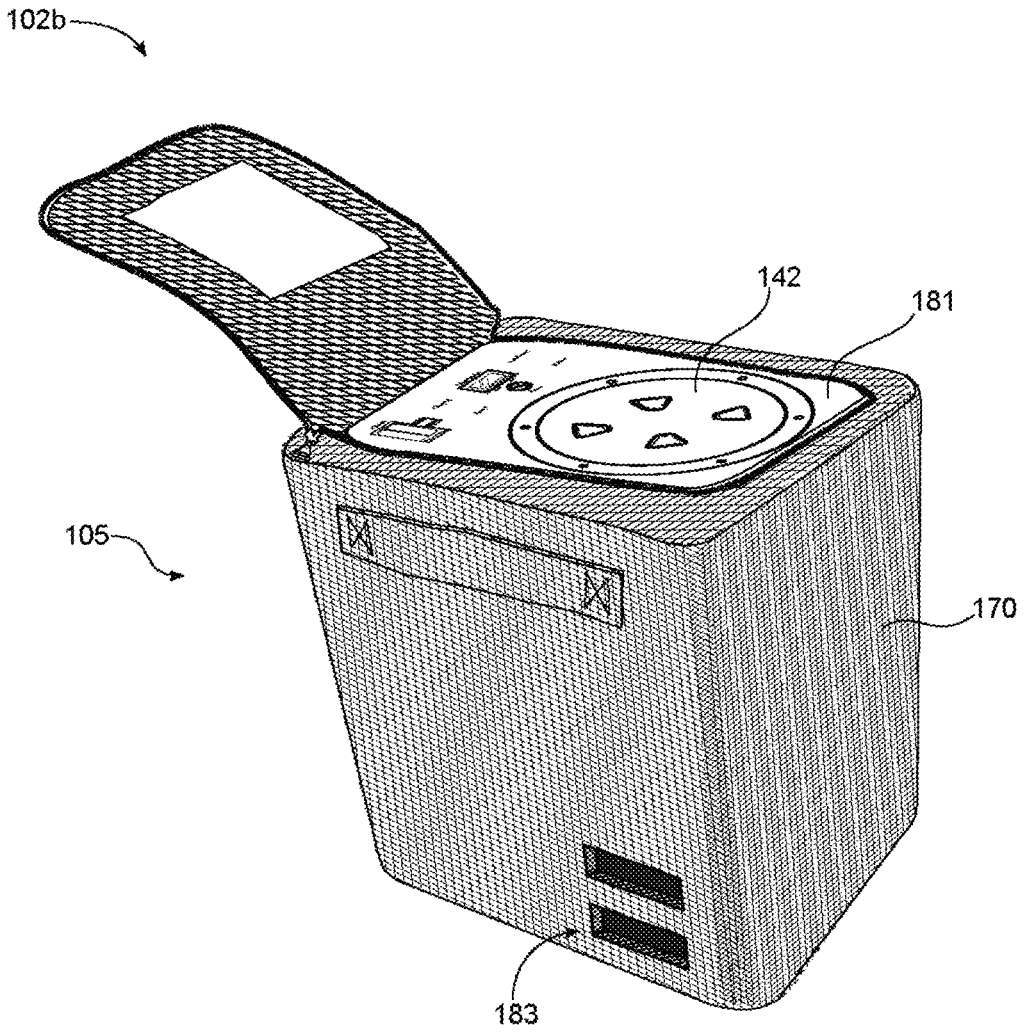

FIGS. 1A and 1B illustrate at least two embodiments of a perspective view of an iso-thermal transport and storage system, or a portable transportable active temperature controlled container. The portability of the container can also refer to designs and configurations of the container that allow the container to be shippable, transportable, or both.

The term "shippable" as used herein, refers to an object, such as the container, that is conveyed as cargo in a hold of a vehicle such as a boat, ship, airplane, truck, or other suitable vehicle. To be shippable, the container can be configured and designed to accommodate national shipping standards, international shipping standards, or both, and comply with parameters, requirements, and restrictions of the standards for movement of the container during shipping. In a preferred embodiment, the assembly is completely self-contained, having its own power source and does not require recharging or an external power source during shipping in order to maintain the desired temperature parameters for the sensitive goods being shipped.

The term "transportable" as used herein, is a term that refers to an object, such as the container, that is conveyed not typically as cargo in a commercial shipping sense, but can be moved or transported with a passenger in a vehicle such as a boat or ship, in an airplane as carry-on luggage, in a truck, van, or personal vehicle, including in a cab or passenger compartment with a driver. Thus, an object may be transportable because of its size, convenience, weight, and self-contained nature without being shippable because it does not meet applicable shipping regulations. Thus, a transportable container might be transportable without being shippable because of a failure to meet some shipping requirement. Alternatively, a container can be both transportable and shippable when it satisfies the relevant shipping requirements.

FIG. 1A shows a perspective view, illustrating an embodiment 102 of iso-thermal transport and storage system or portable transportable active temperature controlled container 100 (also referred to herein as iso-thermal transport and storage system 100). Iso-thermal transport and storage system 100 can protect temperature sensitive and perishable sensitive goods 139 (see FIG. 3B), including biological matter and reproductive cells and/or tissues such as mammalian reproductive cells including horse semen and bovine semen (at least embodying herein a thermal protection system, relating to thermally protecting temperature-sensitive goods 139). Upon reading the teachings of this specification, those with ordinary skill in the art will now appreciate that, under appropriate circumstances, considering issues such as changes in technology, user requirements, etc., other sensitive and perishable sensitive goods, such as cell and tissue cultures, nucleic acids, semen, stem-cells, ovaries, equine reproductive matter, bodily fluids, tissues, organs, and/or embryos plant tissues, blood, platelets, fruits, vegetables, seeds, live insects and other live samples, barely-frozen foods, pharmaceuticals, vaccines, chemicals, sensitive goods yet to be developed, etc., may suffice.

Outer enclosure 105 can comprise a rectangular-box construction, as shown. Outer enclosure 105 can include lid portion 150, enclosure portion 180, and base portion 190, as shown. External dimensions of outer enclosure 105 can be about 36 centimeters (cm) (or about 14 inches (in.)) long with a cross-section of about 23 cm-square (of 9 in.-square), as shown.

Lid portion 150 can attach to enclosure portion 180, with at least one thumbscrew, screw, or fastener 151 and at least one fibrous washer 152, as shown and explained herein. When lid portion 150 attaches to enclosure portion 180, such attachment can provide an airtight seal, as shown, thereby preventing contamination of enclosure portion 180 from external contaminants. Leakages of external contaminants, including microorganisms, into enclosure portion 180 can be prevented by applying pressure between at least one raised inner-portion, of lid portion 150, and threaded cap 142, as shown (also see FIGS. 3A-B) (at least herein embodying wherein said at least one vessel comprises at least one re-sealable surface structured and arranged to ingress and egress the temperature sensitive goods to and from said at least one thermal isolator) (at least herein embodying wherein said at least one re-sealable surface comprises at least one seal structured and arranged to exclude at least one microorganism from said at least one vessel). The upper-lid raised inner-portion of lid portion 150 can be shaped, as shown, by milling, molding, or other suitable process. The upper-lid raised inner-portion can seal to the top of threaded cap 142.

Fibrous washer 152 can comprise an outside diameter of about 1.27 cm (or 0.5 in.), an inner diameter of about 0.64 cm (or about 0.25 in.), and a thickness of about 0.2 cm (or about 0.08 in.). Over-tightening of thumbscrew 151 may cause cracking or distortion of lid portion 150 or degradation of fibrous washer 152. Fibrous washer 152 can protect at least one lid portion 150 from at least one user 200 damaging lid portion 150, due to over-tightening of thumbscrew 151. Fibrous washer 152 can withstand high compression loads, including, for example, loads up to 2000 pounds per square inch (psi) and can prevent vibration between mating surfaces of lid portion 150 and enclosure portion 180. Also, each fibrous washer 152 can provide sufficient friction to prevent loosening of each respective thumbscrew 151, as shown. Further, fibrous washer 152 can comprise a flat, deformable, inexpensive-to-produce, readily available, vulcanized, fibrous material, which can adhere to ANSI/ASME B18.22.1 (1965 R1998). Upon reading the teachings of this specification, those with ordinary skill in the art will now appreciate that, under appropriate circumstances, considering issues such as changes in technology, user requirements, etc., other washer materials, such as gasket paper, rubber, silicone, metal, cork, felt, Neoprene, fiberglass, a plastic polymer (such as polychlorotrifluoroethylene), etc., may suffice.

Thumbscrew 151 can feature at least one plastic grip 163 with at least one tang 164, as shown. User 200 can grasp plastic grip 163 to tighten or loosen thumbscrew 151, for example, by using at least three fingers. User 200 can use tang 164 to apply rotary pressure to plastic grip 163 for tightening or loosening of thumbscrew 151, as shown. Upon reading this specification, those skilled in the art will now appreciate that, under appropriate circumstances, considering such issues as future technology, cost, application requirements, etc., other grips, such as, for example, interlocking heads, wings, friction, etc., may suffice.

In an embodiment, thumbscrew 151 can comprise at least one 300-series stainless-steel stud with ¼-20 threads mounted in phenolic thermosetting resin (which can include reinforced laminate produced from a medium weave cotton cloth impregnated with a phenolic resin binder, such as MIL-i-24768/14 FBG). Plastic grip 163 can have about 3.81 cm (or about 1.5 in.) wide top, can be about 1.59 cm (or about ⅝ in.) thick, and can have about a 0.64 cm (or about 0.25 in.) offset between top portion of screw thread and plastic grip 163. The screw thread can be about 1.91 cm (or about ¾ in.) long. Thumbscrew 151 can comprise part number 57715K55 marketed by McMaster-Carr. Upon reading the teachings of this specification, those with ordinary skill in the art will now appreciate that, under appropriate circumstances, considering issues such as changes in technology, user requirements, etc., other thermosetting composites, such as polyester, epoxy, vinyl ester matrices with reinforcement fibers of glass, carbon, aramid, etc., may suffice.

Stainless steel possesses wear resistance properties appropriate to withstand rough treatment during commercial transport and storage. Stainless steel also provides corrosion proofing to ensure longevity of thumbscrew 151 for applications when embodiment 102 of iso-thermal transport and storage system 100 experiences moisture or corrosive environments. Upon reading this specification, those skilled in the art will now appreciate that, under appropriate circumstances, considering such issues as future technology, cost, application requirements, etc., other screw materials, such as, for example, plastics, other metals, cermets, etc., may suffice.

Upon reading the teachings of this specification, those with ordinary skill in the art will now appreciate that, under appropriate circumstances, considering issues such as changes in technology, user requirements, etc., other fastening means, such as adhesives, fusion processes, other mechanical fastening devices including screws, nails, bolt, buckle, button, catch, clasp, fastening, latch, lock, rivet, screw, snap, and other fastening means yet to be developed, etc., may suffice.

At least one raised section 165 of lid portion 150 can substantially surround thumbscrew 151, as a protective guard, to protect thumbscrew 151 from damage or accidental adjustment, as shown. Raised section 165 can be about 3.18 centimeters (cm) (or about 1.25 in.) tall, about 8.26 cm (or about 3.25 in.) wide, and about 8.26 cm (or 3.25 in.) long, and can be located at each of the four corners of lid portion 150, as shown. Upon reading the teachings of this specification, those with ordinary skill in the art will now appreciate that, under appropriate circumstances, considering issues such as changes in technology, user requirements, etc., other protective guards, such as, for example, protective rims, gratings, handles, blocks, buffers, bulwarks, pads, protections, ramparts, screens, shields, wards and other such protective guards yet to be developed, etc., may suffice.

Figure 3A:
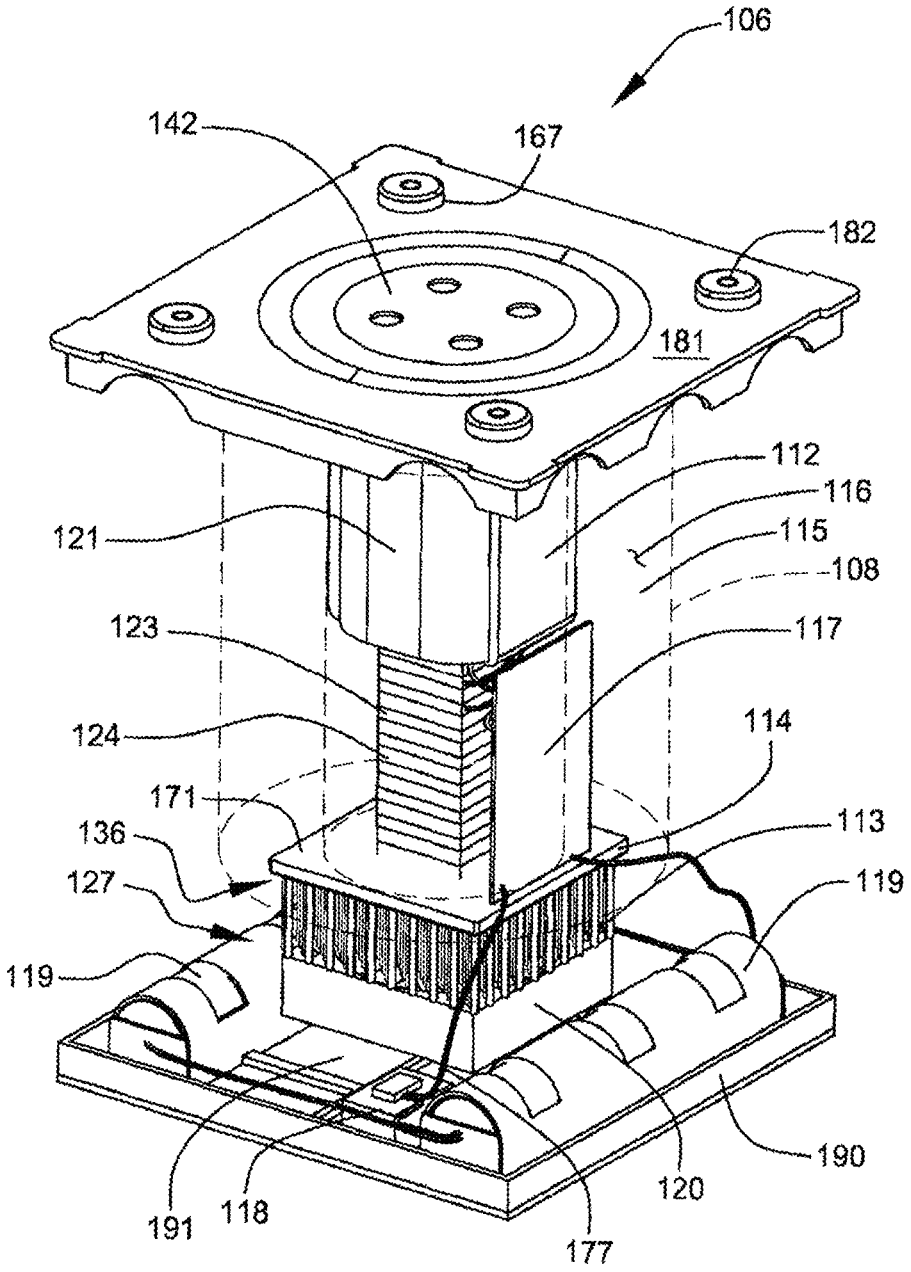
FIG. 3A shows a partially disassembled perspective view, illustrating arrangement of interior components of the active temperature controlled container shown in FIGS. 1A and 1B.

Enclosure portion 180 can be configured to accept at least one screw thread on thumbscrew 151, such as threaded insert 182, as shown in FIG. 3A. Internal thread size of threaded insert 182 can be about ¼-20 with a barrel diameter of about 0.85 cm (or about ⅓ in.), and a flange thickness of about 0.21 cm (or about 1/12 in.). A length of threaded insert 182 can be about 1.43 cm (or about 9/16 in.). Threaded insert 182 can be molded into, or swaged into, enclosure portion 180, as shown in FIG. 3A. Threaded insert 182 can be made of die-cast zinc to provide rust and weather resistance. Threaded insert 182, as used in embodiment 102, can comprise part number 91316A200 sold by McMaster-Carr. Upon reading the teachings of this specification, those with ordinary skill in the art will now appreciate that, under appropriate circumstances, considering issues such as changes in technology, user requirements, etc., other threaded inserts, such as self-tapping, ultrasonic inserts for use on plastic, metal, or wood-base materials yet to be developed, etc., may suffice.

Inner-layer 155, located within lid portion 150, can be formed from urethane, as shown. Inner-layer 155 can be about 3.18 cm (or about 1.25 in.) thick. Inner-layer 155 can be formed from expanded-urethane semi-rigid foam having a density of about of 2 pounds per cubic foot (lb./cu. ft.). In an embodiment, inner-layer 155 can utilize part number SWD-890 as produced by SWD Urethane Company. Urethane is a thermoplastic elastomer that combines positive properties of plastic and rubber. Urethane-foam cells can be created by bubbling action of gases that create small air-filled pockets (which in one embodiment can be no more than about 0.25 cm (or about 1/10 in.) in diameter) that are preferable for creating both resistance to thermal transfer and structural integrity. Further, the urethane foam can act as an impact absorber to protect components of iso-thermal transport and storage system 100 and sensitive and perishable sensitive goods 139 from mechanical shock and vibration during storage and transport, as shown. Upon reading the teachings of this specification, those with ordinary skill in the art will now appreciate that, under appropriate circumstances, considering issues such as changes in technology, user requirements, etc., other forming means, such as other urethane foaming techniques/materials, plastic or other material, for example, polyvinyl chloride, polyethylene, polymethyl methacrylate, and other acrylics, silicones, polyurethanes, or materials such as composites, metals or alloys yet to be developed, etc., may suffice.

Inner-layer 155 of lid portion 150 can be encapsulated in outer-surfacing layer 156 that can comprise a tough semi-rigid-urethane plastic, as shown. Outer-surfacing layer 156 can provide durability and protection for embodiment 102 of iso-thermal transport and storage system 100 during rough handling and incidents of mechanical shock and vibration. Outer-surfacing layer 156 can be tough but amply flexible to withstand direct impact loads associated with normal commercial storage and transportation, as defined by ASTM D3951-98(2004) Standard Practice for Commercial Packaging. Outer-surfacing layer 156 can be about 0.32 cm (or about 1/8 in.) thick, as shown, and in an embodiment includes a density of about 7 lb./cu. ft. Outer-surfacing layer 156 can utilize part number SWD-890 as produced by SWD Urethane Company.

Vacuum insulated panels (VIPs) can be incorporated within lid portion 150 as VIP vacuum-panel 157 and in VIP insulation 108, (at least embodying herein at least one thermal isolator for thermally isolating the temperature sensitive goods) (at least herein embodying wherein said at least one thermal isolator comprises at least one vacuum insulator for vacuum-insulating the temperature sensitive goods). VIPs can advantageously use the thermal insulating effects of a vacuum to produce highly efficient thermal insulation thermal insulation values (R-values) as compared to conventional thermal insulation, as shown. In an embodiment, VIP vacuum-panel 157 and VIP insulation 108 comprise NanoPore RP-150 core as made by NanoPore, Incorporated. NanoPore RP-150 core, which comprises a thermal insulation for embodiment 102 of iso-thermal transport and storage system 100, has an R-value of about R-30 per inch and operates over a temperature range from about −200 degrees centigrade (degree C.) to about 125 degree C. VIP vacuum-panel 157 and VIP insulation 108 can comprise layers of reflective film, having infrared emittance of less than about 0.1, in the infrared spectrum from about one micron to about one millimeter wavelength, separating evacuated volumes, having pressure levels of less than 10 Torr. (at least herein embodying wherein said at least one vacuum insulator comprises at least one layer of reflective material; and at least herein embodying wherein infrared emittance of said reflective material is less than about 0.1, in the infrared spectrum from about one micron to about one millimeter wavelength; and at least herein embodying wherein absolute pressure of said least one evacuated volume is less than about 10 Torr).

VIP vacuum-panel 157 can be encased in urethane foam to protect VIP vacuum-panel 157 from mechanical damage during usage of embodiment 102 of iso-thermal transport and storage system 100, as shown. The thermal insulation of VIP vacuum-panel 157 becomes more effective when an underside of lid portion 150, such as a lid-horizontal decking-surface is in full contact with enclosure upper-horizontal decking-surface 181.

Lid portion 150 also can provide at least one substantially flat-surface 159 that serves as a location for displaying at least one indicia 160, as shown. User 200 can place indicia 160 on at least one flat-surface 159, as shown. Indicia 160 can be aid in designating ownership, advertising, or warnings for embodiment 102 of iso-thermal transport and storage system 100 and/or the contents contained in embodiment 102 of iso-thermal transport and storage system 100, as shown.

At least one rivet 162 can be used when enclosure portion 180 is formed from at least one wall section 201 and at least one corner section 202, which require a fastening means to join the sections together, as shown. Wall section 201 can be about 0.32 cm (or about 1/8 in.) thick, can be made from aluminum alloy 6061, and in an embodiment can be aluminum alloy 661 comprising T6 tempering that is anodized coated. Corner section 202 can be about 0.32 cm (or about 1/8 in.) thick, and can made from aluminum alloy 6061, including T6 tempering and an anodized coating. At least one rivet 162 can be used to hold at least one wall section 201 attach to at least one corner section 202. Rivet 162 can be selected to withstand tension loads parallel to the longitudinal axis of rivet 162 and sheer loads perpendicular to the longitudinal axis of rivet 162.

Rivet 162 can comprise a blind rivet, a solid rivet, or any other type of rivet or suitable fastener. Rivet 162 can be made from aluminum alloy 2024, as shown. Rivet 162 can have a head of about 0.85 cm (or about 1/3 in.) diameter and can have a shaft of about 0.40 cm (or about 5/32 in.) diameter. Rivet 162 can comprise part number 97525A470 from McMaster-Carr. Hole size (in wall section 201 and corner section 202) for rivet 162 can be range from about 0.41-0.43 cm (or about 0.16-0.17 in.) in diameter. The shaft of rivet 162 can be about 1.27 cm (or about 0.5 in.) in diameter and can be upset to form a buck-tail head about 0.85 cm (or about 1/3 in.) diameter after being inserted through holes, in wall section 201 and corner section 202, located near at least one corner of outer enclosure 105, as shown herein. Upon reading the teachings of this specification, those with ordinary skill in the art will now appreciate that, under appropriate circumstances, considering issues such as changes in technology, user requirements, etc., other securing means, such as bolts, buckles, buttons, catches, clasps, fastenings, latches, locks, rivets, screws, snaps, adapters, bonds, clamps, connections, connectors, couplings, joints, junctions, links, ties yet to be developed, etc., may suffice.

User 200 may impart rough treatment to embodiment 102; thus, the design can employ plastic material capable of absorbing impact forces. The nature of the construction of embodiment 102, in combination with expandable urethane 115 as insulation, assists isolation of thermoelectric assembly or thermoelectric heat pump assembly 123, as shown in FIG. 3A, which is prone to damage from mechanical shock and/or vibration, from mechanical shock. Upon reading the teachings of this specification, those with ordinary skill in the art will now appreciate that, under appropriate circumstances, considering issues such as changes in technology, user requirements, etc., other impact absorption materials, for example, polyvinyl chloride, polyethylene, polymethyl methacrylate, and other acrylics, silicones, polyurethanes, composites, rubbers, soft metals or other such materials yet to be developed, etc., may suffice.

Enclosure portion 180 comprises at least one vent 183, which can be located on at least one vertical surface 161 and in close proximity to base portion 190, as shown. Vent 183 can allow ambient air to freely enter and circulate throughout at least one interior portion of outer enclosure 105, for example, by using at least one fan 120, as shown. Vent 183 can provide about a 25% free flow opening (of the lower portion of wall section 201), through which air can be drawn in or exhausted, as shown. Vent 183 can comprise about 80 slots 184, each about 0.85 cm (or about ⅓ in.) wide and about 2.54 cm (or about 1 in.) high, as shown. Upon reading the teachings of this specification, those with ordinary skill in the art will now appreciate that, under appropriate circumstances, considering issues such as changes in technology, user requirements, etc., other opening means, such as holes, apertures, perforations, slits, or windows yet to be developed but which are capable of ambient air ingress and egress, etc., may suffice.

FIG. 1B shows a perspective view of thermoelectric transport or storage device 102*b*. Thermoelectric transport or storage device 102*b* comprises outer enclosure 105, inside of which is disposed a vessel or container 121. Vessel 121 is configured to safely contain temperature sensitive and perishable goods 139 for storage, transportation, and shipping. Vessel 121 can be placed within, or accessed from, threaded cap 142, which can be disposed on or within enclosure upper-horizontal decking-surface 181. A vent 183 can be formed in a side surface of outer enclosure 105 to allow ambient air from without thermoelectric transport or storage device 102*b* to be circulated by fan 120 within storage device 102*b* to assist in controlling a temperature of temperature sensitive and perishable goods 139. In an embodiment, a carrying case 170 can optionally be disposed around outer enclosure 105 to add additional padding, covering, protection, or information to the outer enclosure. Carrying case 170 can be formed of cloth, plastic, or any other natural or synthetic material, and can include one or more handles or adjustable openings. The adjustable openings that can be temporarily opened or closed by zippers, snaps, hook and loop fasteners, buttons, latches, cords, or other suitable devices to provide or restrict access to various portions of thermoelectric transport or storage device 102*b*, including threaded cap 142, vessel 121, upper-horizontal decking-surface 181, and vent 183.

Figure 2A:
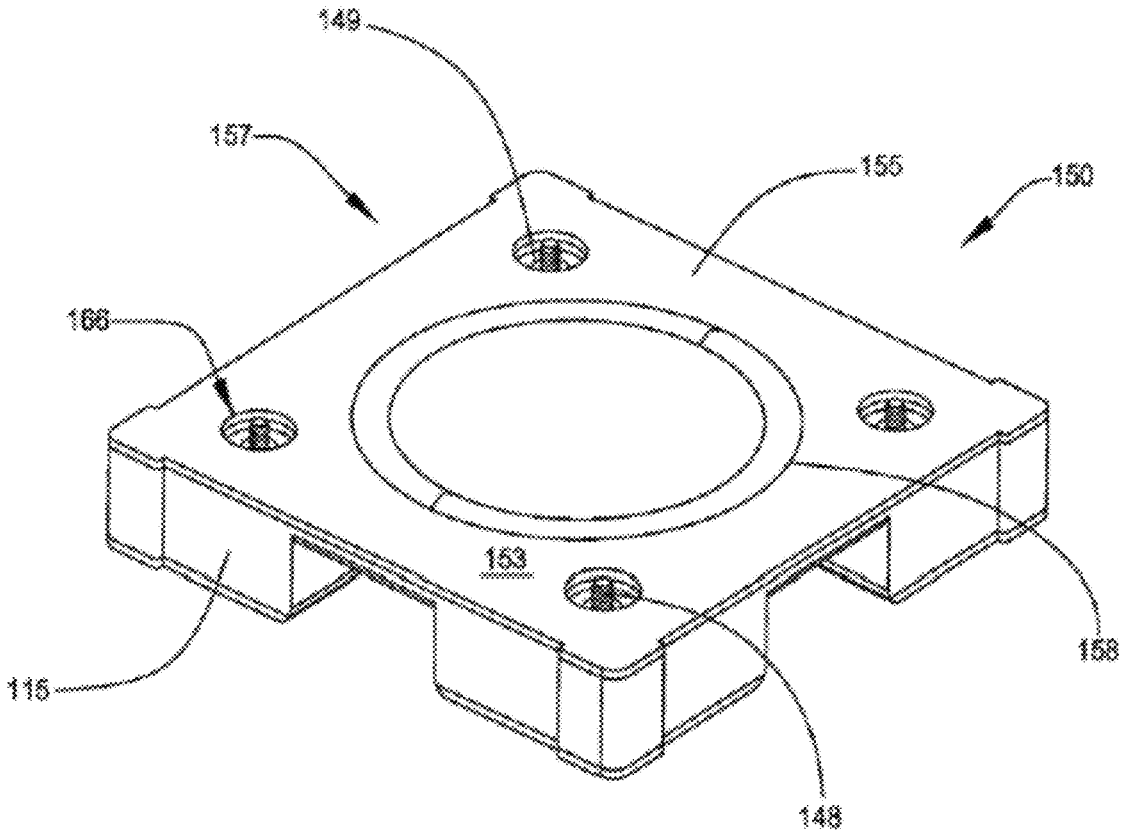
FIGS. 2A-2C show various perspective and plan views, illustrating various embodiment of a lid portion of the embodiments of the active temperature controlled container shown in FIGS. 1A and 1B.

FIG. 2A shows a bottom-side perspective view, illustrating lid portion 150 of embodiment 102*a* of iso-thermal transport and storage system 100, according to an embodiment.

Figure 3B:
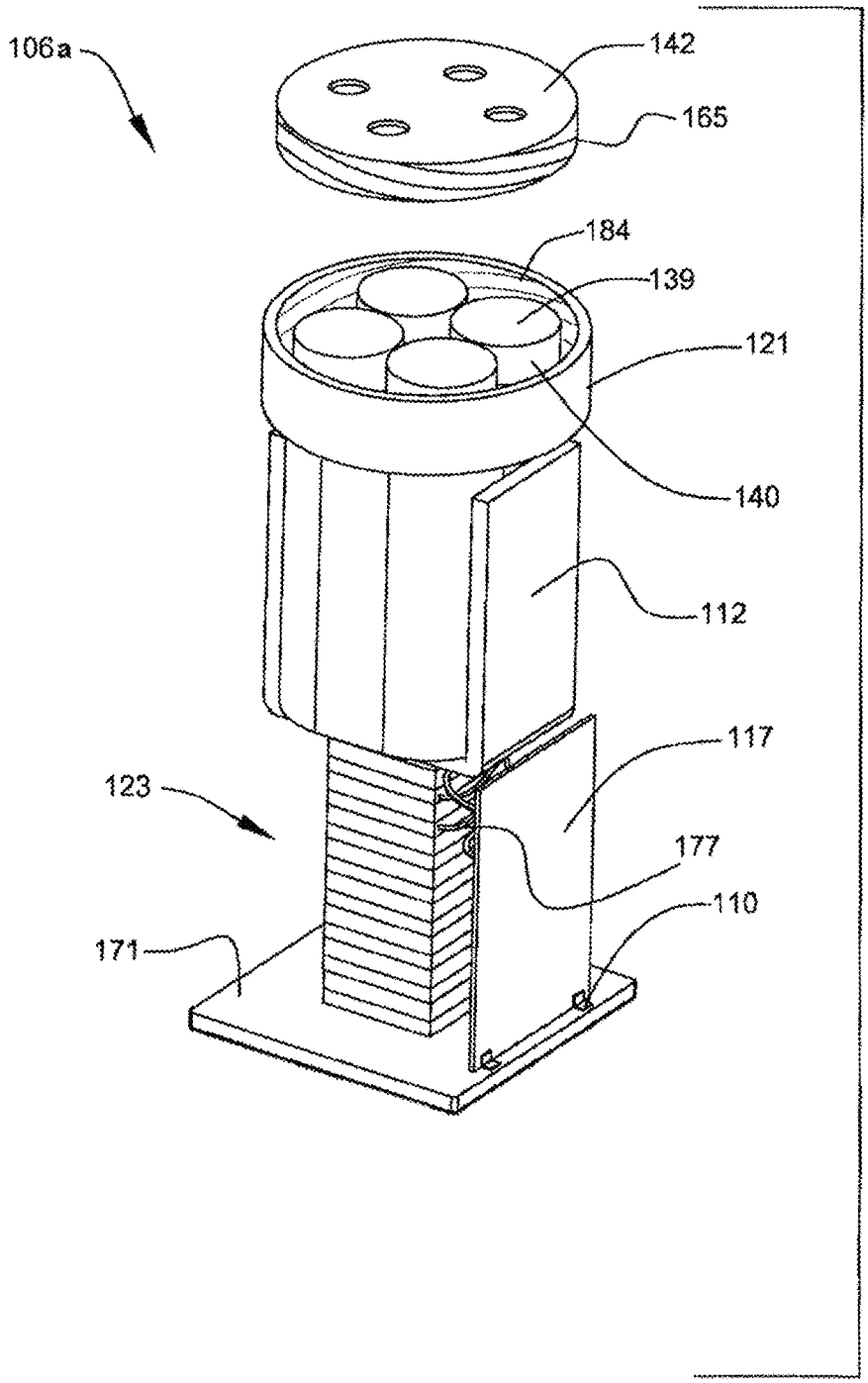
FIG. 3B shows a partially exploded perspective view, illustrating the order and arrangement of the inner working assembly and sample placements of the active temperature controlled container shown in FIGS. 1A and 1B.

Lid-horizontal decking-surface 153 can be molded, alternately machined, to be a mating and sealing surface with enclosure upper-horizontal decking-surface 181, as shown (also see FIGS. 3A-B). Lid-horizontal decking-surface 153 and enclosure upper-horizontal decking-surface 181 can come into complete contact with each other, as shown in FIG. 1A, forming one of two barriers between the external environment and the contents of vessel or container 121, as shown (at least embodying herein wherein said at least one thermal isolator comprises at least one vessel structured and arranged to contain the temperature sensitive goods). Upon reading the teachings of this specification, those with ordinary skill in the art will now understand that, under appropriate circumstances, considering issues such as changes in technology, user requirements, etc., other enclosure means, such as lids, caps, covers, hoods, or floors, yet to be developed, etc., may suffice.

VIP vacuum-panel 157 can be embedded in lid portion 150 and can provide thermal insulation within embodiment 102, as shown. VIP vacuum-panel 157 can be about 4 inches wide, about 4 inches long and about 1 inch thick, as shown. Upon reading this specification, those skilled in the art will now appreciate that, under appropriate circumstances, considering such issues as future technologies, application requirements, etc., other VIP vacuum panel sizes, may suffice.

At least one retainer 149 can hold thumbscrew 151 and fibrous washer 152 from becoming detached from lid portion 150, as shown. Retainer 149 can slide smoothly down the threads when installed, such that thumbscrew 151 and fibrous washer 152 can be retained within at least one lid alignment well 166 in lid portion 150, as shown. Retainer 149 can be about 5/16 inch inner diameter, about 5/8 inch outer diameter, and can be made of black phosphate spring steel, as shown. Retainer 149 can comprise part number 94800A730 from McMaster-Carr. Upon reading the teachings of this specification, those with ordinary skill in the art will now appreciate that, under appropriate circumstances, considering issues such as changes in technology, user requirements, etc., other retaining means, such as clasps, clamps, holders, ties and other retaining means yet to be developed, etc., may suffice. Lid alignment well 166 can align with at least one lid alignment post 167 (see FIG. 3A). Lid alignment well 166 and lid alignment post 167 can allow quick alignment of lid portion 150 to enclosure portion 180.

Figure 2B:
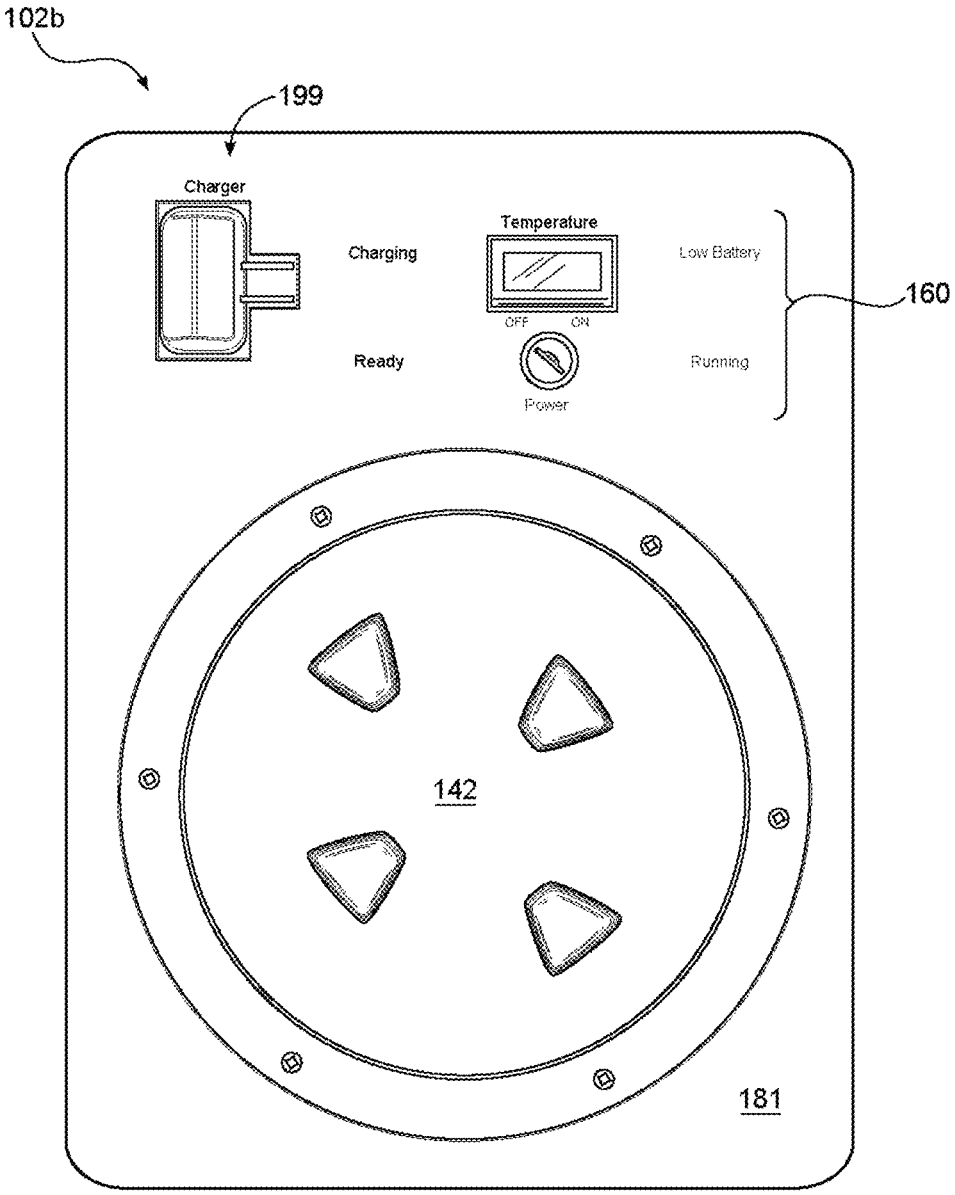

FIG. 2B shows a two-dimensional plan view of a top portion of thermoelectric transport or storage device 102*b* shown previously in the perspective view of FIG. 1B.

As shown in FIG. 2B, threaded cap 142 can be disposed on or within enclosure upper-horizontal decking-surface 181 and over vessel 121. FIG. 2B shows threaded cap 142 in a closed position disposed over, securing, and enclosing vessel 121 in which temperature sensitive and perishable goods 139 can be placed, stored, and removed. A number of indicia 160 can also be optionally placed on, or within, enclosure upper-horizontal decking-surface 181. Indicia 160 can include, for example, a charging indicator and a ready indicator, such as a light, for indicating when battery system 119 is being charged through charger 199, which can include an extendable power cord and adapter to be plugged into one or more standard electrical outlets, or is fully charged and ready for storage or shipment of temperature sensitive goods 139. Indicia 160 can further include a variable message indicator such as a lighted display that can show a desired or actual temperature within vessel 121. Indicia 160 can further include a lock that can be turned with a key or other device to turn power on and off to storage device 102*b*, while a low battery indicator and a running indicator can show, such as by a light, whether the unit is running, has a low batter, or both.

Figure 2C:
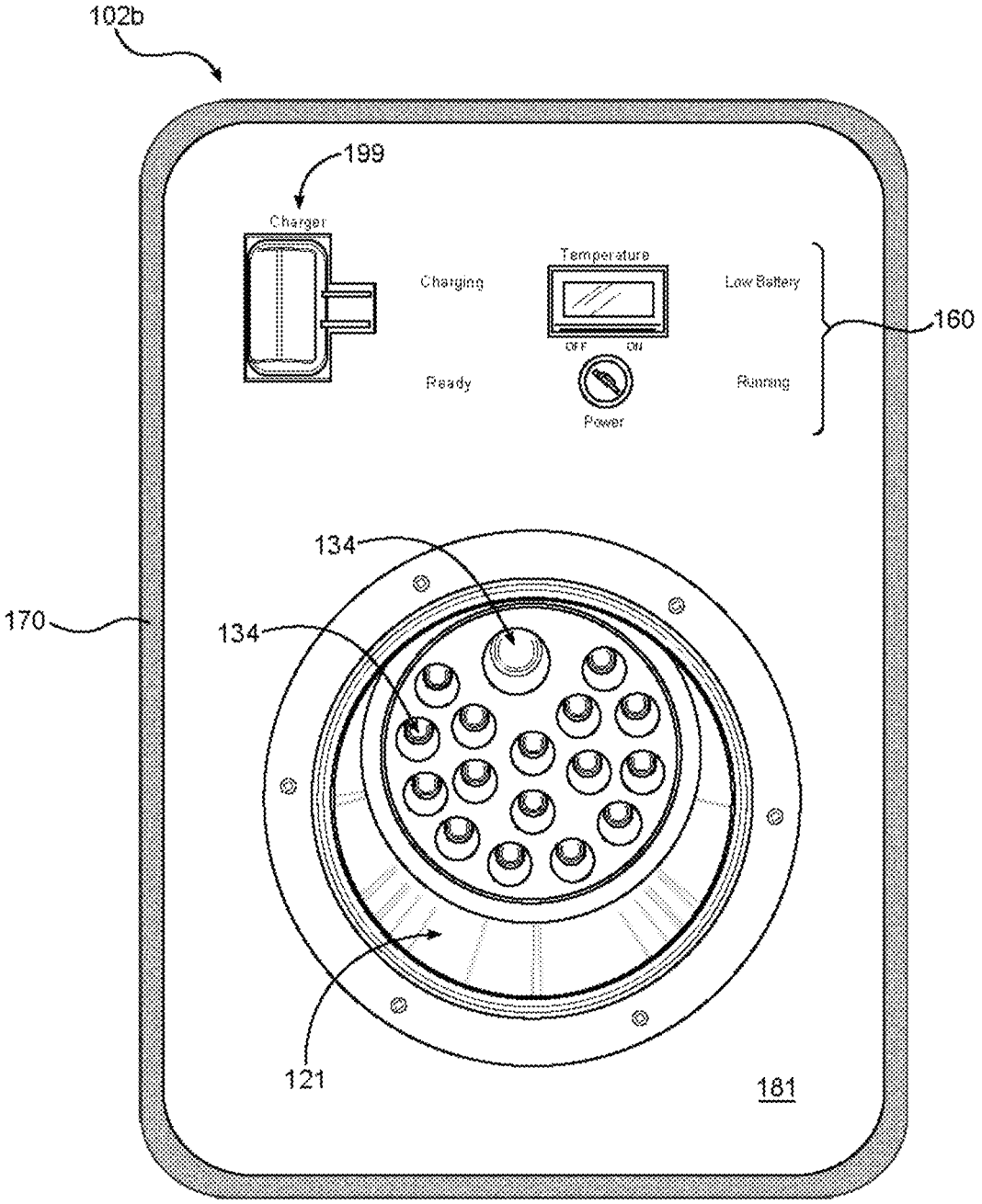

FIG. 2C shows a two-dimensional plan view of a top portion of thermoelectric transport or storage device 102*b* similar to that shown previously in FIG. 2B.

FIG. 2C differs from FIG. 2B in that threaded cap 142 has been removed from enclosure upper-horizontal decking-surface 181 such that vessel 121 is open and accessible, allowing for insertion, removal, or inspection of temperature sensitive and perishable goods 139. As shown in FIG. 2C, an interior surface of vessel 121 can be optionally configured to comprise openings 134 in an interior surface of vessel 121. A size, shape, and number of openings 134 can be customizably adjusted and configured to receive one or more sample tubes 140, including vials, test tubes, or other suitable containers for containing temperature sensitive and perishable goods 139.

FIG. 3A shows a partially disassembled perspective view, illustrating an optional arrangement of inner-workings assembly 106 of embodiments 102 of iso-thermal transport and storage system 100. FIG. 3A also shows threaded cap 142, which can be about 7½ inches in diameter and about ¾ inch thick. Threaded cap 142 can assist isolation of sensitive and perishable sensitive goods 139 from its surroundings, as shown. Upon reading the teachings of this specification, those with ordinary skill in the art will now appreciate that, under appropriate circumstances, considering issues such as changes in technology, user requirements, etc., other methods of isolation, such as caps, coverings, packings, gaskets, stoppers yet to be developed, etc., may suffice.

FIG. 3A also shows at least one battery system 119, mounted on base portion 190. Battery system 119 can provide a portable, reliable power source for long durations while sensitive and perishable sensitive goods 139 are being transported in embodiment 102. At least one circuit board 117 can be wired to, and powered by, battery system 119 using at least one wire 177, as shown. Battery system 119 of the present disclosure can be about 3.6 volt DC supply. Battery system 119 can be rechargeable, can provide a source of power for thermo-electric assembly 123, and can be controlled by at least one safety on/off switch 118, as shown. Where an external power source is available, battery system 119 may be recharged while embodiment 102 is in storage or transport. Upon reading the teachings of this specification, those with ordinary skill in the art will now appreciate that, under appropriate circumstances, considering issues such as changes in technology, user requirements, etc., other power sources, such as accumulators, dry batteries, secondary batteries, secondary cells, storage cells, storage devices, wet batteries or other such storage means yet to be developed, or a fixed power source, etc., may suffice.

Wire 177 as shown comprises about 16 AWG coated 26/30 gage copper stranded-conductors with an insulation thickness of about 1/64 inches and a diameter of about 1/12 inches, as shown. Operating temperature range of wire 177 can be from about −40° C. to about 105° C. Insulation covering conductors of wire 177 can be color-coded polyvinyl chloride (PVC). Voltage rating of wire 177 is about 300V. Wire 177 can be marketed by Alpha Wire Company part number 3057. Upon reading the teachings of this specification, those with ordinary skill in the art will now appreciate that, under appropriate circumstances, considering issues such as changes in technology, user requirements, etc., other wiring configurations for example parallel, other series/parallel connections, other size wire, etc., may suffice.

FIG. 3A also shows thermo-electric assembly 123, can comprise at least one thermo-electric semi-conductor node 133 (see FIG. 4A) capable of being wired in at least one series and/or parallel configuration to at least one battery system 119. Thermoelectric semi-conductor node 133 can provide an incremental temperature staging means (at least embodying herein at least one thermo-electric heat pump adapted to control—at least one temperature of the temperature sensitive goods; wherein said at least one thermoelectric heat pump comprises at least one thermo-electric device adapted to active use of the Peltier effect). Thermo-electric assembly 123 can be about 7⅝ inches high, about 5 inches long and about 5 inches wide when stacked, as shown. Upon reading the teachings of this specification, those with ordinary skill in the art will now appreciate that, under appropriate circumstances, considering issues such as changes in technology, user requirements, etc., other heat-transferring effects, such as induction, thermal radiation means yet to be developed, etc., may suffice.

In embodiment 102, user 200 may select at least one set-point temperature for sensitive and perishable sensitive goods 139. Embodiment 102 can then automatically maintain the at least one set-point temperature for sensitive and perishable sensitive goods 139, for a duration necessary to store or transport sensitive and perishable sensitive goods 139 to at least one predetermined destination. Embodiment 102 can use thermo-electric assembly 123, in conjunction with fan 120, in at least one closed-loop feedback sensing of at least one thermocouple 124, as shown. Thermocouple 124 can comprise at least one temperature-sensing chip, such as produced by Dallas Semiconductor part number DS18B20. Thermocouple 124 can be used as a single-wire programmable digital-thermometer to measure temperatures at thermocouple 124, as shown. Upon reading the teachings of this specification, those with ordinary skill in the art will now appreciate that, under appropriate circumstances, considering issues such as changes in technology, user requirements, etc., other temperature tuning means, such as adjusters, dials, knobs, on/off power switches, switches, toggles, tuners, thermo-conductive means or other temperature tuning means yet to be developed, etc., may suffice.

Embodiment 102 can comprise at least one vessel 121 designed to store and contain sensitive and perishable sensitive goods 139, as shown. Vessel 121 can be made from urethane or, alternately, aluminum. Upper section of vessel 121 can comprise at least one inner threaded portion 189 that permits lid 142, having an external threaded portion 185, to be threaded together (also see FIG. 3B). Threading together of upper section of vessel 121 and lid 142, as shown in FIG. 3B, can provide a seal that isolates sensitive and perishable sensitive goods 139 from the local environment. Lid 142 alternately may have a friction fit sealing relationship with vessel 121, as shown. Tolerances for friction fit will depend on pressure required to be maintained within vessel 121. Upon reading the teachings of this specification, those with ordinary skill in the art will now appreciate that, under appropriate circumstances, considering issues such as changes in technology, user requirements, etc., other means of attaching, such as, clamped-lid mechanisms, bolted lids, joined by adhesives and other means yet to be developed, etc., may suffice.

Aluminum 6069-T4 may be used, due to its light weight and ability to withstand high pressure, should sensitive and perishable sensitive goods 139 need to be maintained at a high pressure. Aluminum can be used because of its high thermal conductivity of about, at about 300° Kelvin (300° K), 237 watts-per meter-degree Kelvin ($W \cdot m^{-1} \cdot K^{-1}$) manufacturability, light weight, resistance to corrosion, and relative dimensional stability (low thermal expansion rate) over a substantial working temperature range. During the heat transfer processes, materials store energy in the intermolecular bonds between the atoms. When the stored energy increases (rising temperatures of the material), so does the length of the molecular bond. This causes the material to expand in response to being heated, and causes contraction when cooled. Embodiment 102 can overcome this problem by using aluminum due to the relatively low thermal expansion rate of about 23.1 micro-meters per meter per degree Kelvin ($\mu \cdot m^{-1} \cdot K^{-1}$) (300° K). This property can allow embodiment 102 to effectively manage thermally induced linear, area, and volumetric expansions throughout a wide range of ambient temperatures and desired set-point temperatures for sensitive and perishable sensitive goods 139. Upon reading the teachings of this specification, those with ordinary skill in the art will now appreciate that, under appropriate circumstances, considering issues such as changes in technology, user requirements, etc., other materials, such as, for example, copper, copper alloys, other aluminum alloys, low-thermal-expansion-composite constructions, etc., may suffice.

At least one volume 116 exists between VIP vacuum-panel 157 and vessel 121 mounted above thermo-electric assembly 123, as shown. Volume 116 can be filled with expandable urethane 115, as shown. The expandable urethane 115 foam can have a density of about 2 lb/cu. ft. Expandable urethane 115 can secure all components within the upper portion of embodiment 102, as shown. Expandable urethane 115 foam can be only allowed to fill the portion shown within the illustration so as to allow ample available space for heat sink 114, at least one fan assembly 127, and at least one battery system 119 to operate in a non-restricted manner, as shown (also see FIG. 3B).

Alternately, volume 116 between VIP vacuum-panel 157 and vessel 121 can be filled up to three layers of about ½ inch thick VIPs. Such VIPs can be curved around vessel 121 and thermo-electric assembly 123, creating a total minimum thickness of about 11/2 inches, as shown. Square-box style VIPs may also be used depending on specific geometries associated with embodiment 102. After such VIPs are positioned around vessel 121 and thermo-electric assembly 123, the remaining cavity areas are filled with expandable urethane 115. Upon reading the teachings of this specification, those with ordinary skill in the art will now understand that, under appropriate circumstances, considering issues such as changes in technology, user requirements, etc., other surface cooling means, such as appendages, projections, extensions, fluid heat-extraction means and others yet to be developed, etc., may suffice.

All of the mentioned items within inner-workings assembly 106 lose efficiency if not cooled when used as a heat sink rather than a cool sink. Fan 120 can circulate ambient air through vent 183, impinging on at least one fin 113, as shown. Fin 113 can absorb heat from the air (in heating mode) or reject heat to the air (cooling mode). Fin 113 further can transport heat from/to its surface into heat sink 114, through conductive means. Fin 113 and heat sink 114 can be comprised of 3000 series aluminum. Aluminum alloys have the significant advantage that they are easily and cost-effectively formed by extrusion processes. Upon reading this specification, those skilled in the art will now appreciate that, under appropriate circumstances, considering such issues as future technologies, cost, available materials, etc., other fin and heat sink materials, such as, for example, other aluminum alloys, copper, copper alloys, ceramics, cermets, etc., may suffice. Heat sink 114 can be designed for passive, non-forced air-cooling, as shown.

Fan 120 can provide necessary thermal control by creating an active means of air movement onto heat sink 114 surfaces, as shown. Fan assembly 127 can be about 37/8 inches long, about 37/8-inches wide and about 11/3 inches high. Fan 120 can comprise model number GM0504PEV1-8 part number GN produced by Sunon. Fan 120, can be rated at about 12 VDC, however, fan 120 can operate at 5 VDC. Airflow can be about 5.9 cubic feet per minute (CFM) at a speed of about 6000 revolutions per minute (rpm) with a power consumption of about ⅜ watts (W). Noise of fan 120 can be limited to about 26 decibels (dB). Fan 120 can weigh about 7.5 grams (g).

Fan 120 alternately can be operated at about 5 volts with a DC/DC boost converter, not shown. The DC/DC boost converter can be a step-up type, possibly comprising a start-up of less than 0.9 VDC with about 1 mill-ampere (mA) load. The DC/DC boost converter can comprise part number AP1603 as marketed by Diodes Incorporated. Upon reading the teachings of this specification, those with ordinary skill in the art will now understand that, under appropriate circumstances, considering issues such as changes in technology, user requirements, etc., other conversion means, such as, for example, buck converter or buck-boost converter yet to be developed, etc., may suffice.

Heat sink 114 can comprise at least one heat-sink plate 136, base surface 171 (at least embodying herein wherein said at least one vessel comprises at least one heat-transferring surface structured and arranged to conductively exchange heat to and from said at least one temperature controller), and fins 113. Heat sink 114 can be FH-type as produced by Alpha Novatech, Inc., as shown. A configuration of heat sink 114 can comprises about 200 individual, fins 113, shaped hexagonally, possibly comprising dimensions of about ⅛ inch wide across the flats and about 11/3 inches long, as shown. Fins 113 can be arranged in a staggered relationship on heat-sink plate 136, as shown. Heat-sink plate 136 can be about ¼ inch thick, about 37/8 inches wide and about 3⅞ inches long, as shown. Heat-sink plate 136 and fins 113 can comprise a one-piece extrusion. Base surface 171 of heat sink 114 can be flat and smooth to ensure adequate thermal contact with the object being cooled or heated, as shown. Upon reading the teachings of this specification, those with ordinary skill in the art will now understand that, under appropriate circumstances, considering issues such as changes in technology, user requirements, etc., other heat sink materials, such as copper, gold, silver, brass, tungsten, ceramics, cermets, or metal alloys of different sizes and configurations, etc., may suffice.

Embodiment 102 can be configured with or without a sample rotating assembly, and as such is suitable for handling sensitive and perishable sensitive goods 139 that may require to be rotated or agitated or that do not need to be rotated or agitated to preserve the required quality. Fan 120 can blow ambient air pulled in through vent 183, as shown in FIG. 1B. Heat sink 114 can comprise fin 113, which can be mounted or otherwise configured to be perpendicular to fan 120, as shown. Heat sink 114 can be configured for providing maximum surface area exposure to air currents from fan 120, to maximize the rates of cooling or heating within embodiment 102, as shown. The method of forced-convection heat-transfer can create fewer fluctuations in temperature of sensitive and perishable sensitive goods 139 over any extended time. Upon reading the teachings of this specification, those with ordinary skill in the art will now appreciate that, under appropriate circumstances, considering issues such as changes in technology, user requirements, etc., other heat sink cooling devices, such as aerators, air-conditioners, and ventilators yet to be developed, etc., may suffice.

At least one retainer 112 can be attached at its base to thermoelectric assembly 123, and can partially wrap around vessel 121, thereby permitting user 200 to lift vessel 121 out of embodiment 102. Retainer 112 can be a means to ensure vessel 121 is held in place, as shown. Retainer 112 can be formed in a U-shape, as shown, and can be constructed of smooth-cast-roto-molded urethane as made by Smooth-On manufacturers. Smooth-Cast® ROTO® urethane is a semi-rigid plastic and can be selected for its density-control, structural and insulating characteristics. Smooth-Cast® ROTO® has a shore D hardness of about 65, a tensile strength of about 2400 psi, tensile modulus of about 90,000 psi, with a minimal shrinkage of about 0.01 in/in over a seven-day period. Upon reading the teachings of this specification, those with ordinary skill in the art will now appreciate that, under appropriate circumstances, considering issues such as changes in technology, user requirements, etc., other retaining means, such as catches, clasps, clenches, grips, holds, locks, presses, snaps, vices, magnets, or mechanical attaching means yet to be developed, etc., may suffice.

Retainer 112 can alternately be manufactured from aluminum, due to its high thermal conductivity and low mass density. The high thermal conductivity of retainer 112 can efficiently transport heat between thermoelectric assembly 123 and vessel 121 with a minimum of temperature difference between thermoelectric assembly 123 and vessel 121. This efficient heat conduction can support temperature stability for sensitive and perishable sensitive goods 139, contained within vessel 121, as shown. Upon reading the teachings of this specification, those with ordinary skill in the art will now appreciate that, under appropriate circumstances, considering issues such as changes in technology, user requirements, etc., other high thermal conductors, such as copper, brass, silver, gold, tungsten and other conductive element alloys yet to be developed, etc., may suffice.

Thermoelectric assembly 123 can be mounted on base surface 171 of heat sink 114 and can connect to retainer 112, as shown. Upon reading the teachings of this specification, those with ordinary skill in the art will now appreciate that, under appropriate circumstances, considering issues such as changes in technology, user requirements, etc., other retaining means, such as catches, clasps, clenches, grips, holds, locks, nippers, presses, snaps, vices, magnets, or mechanical attaching means yet to be developed, etc., may suffice.

Circuit board 117 can be mounted substantially parallel to thermoelectric assembly 123 by at least one bracket 110, as shown. Also, circuit board 117 can mount to flat upper surface of heat sink 114, as shown. Upon reading the teachings of this specification, those with ordinary skill in the art will now appreciate that, under appropriate circumstances, considering issues such as changes in technology, user requirements, cost, etc., other circuit board mountings, such as suspension in foam insulation, epoxies, snap-in, cable suspensions, etc., may suffice.

Figure 4A:
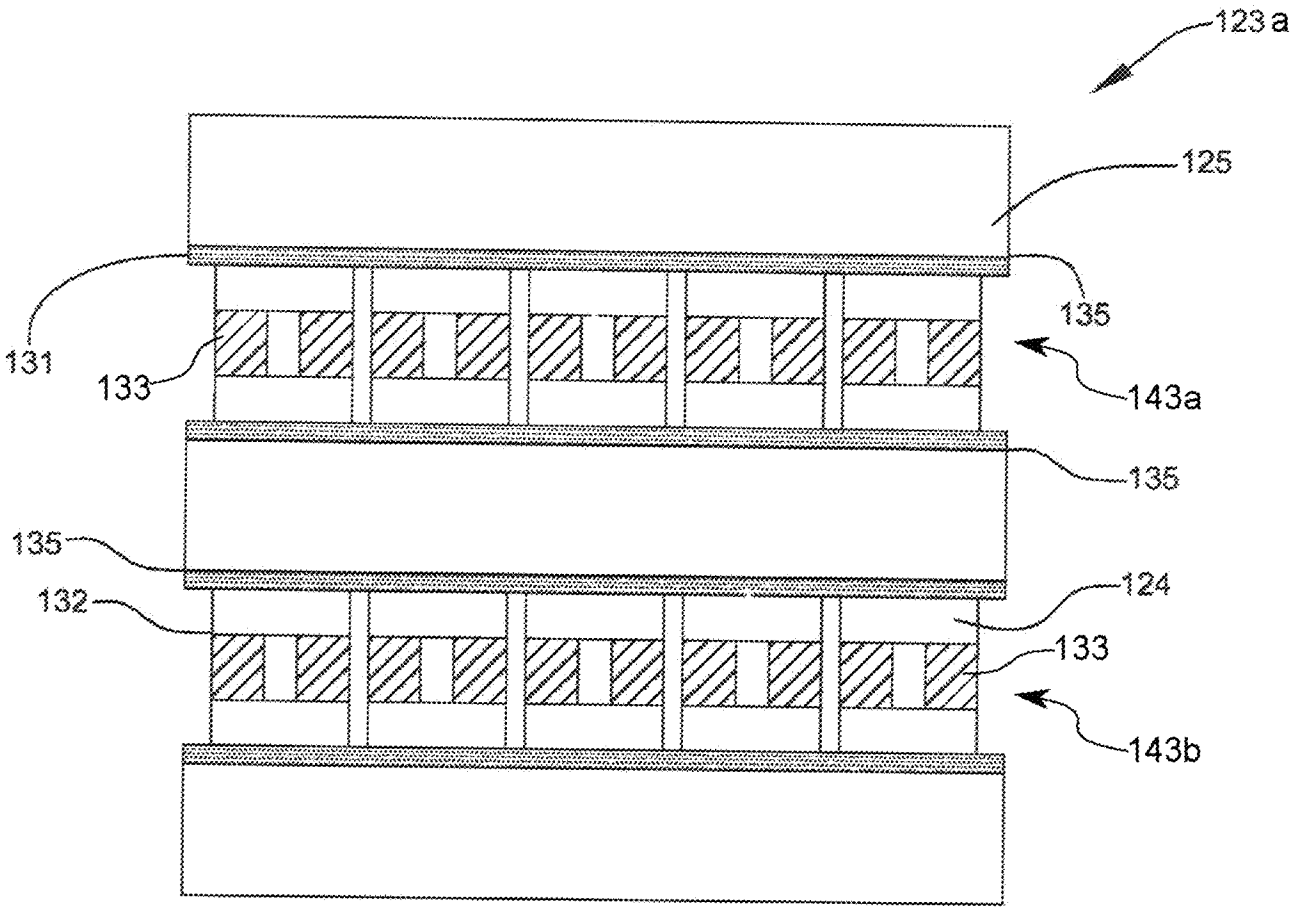
FIGS. 4A and 4B provide side profile views, illustrating a thermoelectric assembly of the active temperature controlled container, according to embodiments disclosed in accordance with FIGS. 1A and 1B.

Circuit board 117 can control and regulate the functioning of thermoelectric assembly 123, according to electronic feedback from thermocouple 124 within thermoelectric assembly 123, as also shown in FIG. 4A. At least one mounting hole can be present in circuit board 117 and can allow mounting by bracket 110, as shown. Upon reading the teachings of this specification, those with ordinary skill in the art will now appreciate that, under appropriate circumstances, considering issues such as changes in technology, user requirements, etc., other mounting means for example hooks, magnets, mechanical fastening means yet to be developed, fusion means, etc., may suffice.

FIG. 3B shows a partially exploded perspective view, illustrating the order and arrangement of inner-workings assembly 106 of iso-thermal transport and storage system 100, in which sample tubes 140, which are configured to contain temperature sensitive and perishable goods 139, are disposed within vessel 121. Furthermore, FIG. 3B illustrates a non-limiting example of an embodiment of inner-workings assembly 106*a* where thermoelectric assembly 123 is used in an active temperature controlled container 100 (also called iso-thermal transport and storage system 100) where a fan 120 is not required to properly operate the active temperature controlled container 100. For example, thermoelectric assembly 123 may operate in a cool sink mode whereby temperature sensitive and perishable goods 139 disposed within vessel 121 are heated rather than cooled. In embodiments using cool sink mode, the fan 120 may be omitted and save a significant amount of space within and reduce the complexity of the active temperature controlled container 100.

Alternatively, the inner-workings assembly 106*a* shown in FIG. 3B can be modified by adding fan 120 and fan assembly 127 as shown in inner-workings assembly 106 of FIG. 3A.

FIG. 4A provides a side profile view, illustrating thermoelectric assembly 123*a* of iso-thermal transport and storage system 100, according to an embodiment disclosed in accordance with FIGS. 1A and 1B.

At least one thin non-electrically conductive layer 131 can electrically separate thermal capacitor 125 from thermoelectric unit layers or thermoelectrics (TE) 143 (see 143*a* and 143*b* in FIG. 4A) while maintaining thermal conductivity. Thermoelectric unit layers 143 can comprise one or more thermoelectric semi-conductor node 133, and can additionally optionally comprise one or more thermocouples 124 as well as one or more of a thin non-electrically conductive layer 131, a silver-filled two-component epoxy 132, and a thin-film thermal epoxy 135. At least one thin-film thermal epoxy 135 can fill microscopic imperfections between thin non-electrically conductive layer 131 and thermal capacitor 125. Upon reading this specification, those skilled in the art will now appreciate that, under appropriate circumstances, considering such issues as future technology, cost, application needs, etc., other thermal conductivity maximizers, such as, for example, thermal greases, thermal dopes, molecularly smoothed surfaces, etc., may suffice.

As indicated above, thermoelectric unit layers 143 of thermoelectric assembly 123*a* can comprise a plurality of thermoelectric semi-conductor nodes 133, which are connected physically (thermally) in series, parallel, or both, and electrically in series, parallel, or both, and can use at least one battery system 119 to create a device for active temperature control as shown. While the thermoelectric units can be bidirectional to alternately provide both heating and cooling at different times, as described below, some used of the thermoelectric unit layer or TE can be used for heating only. Additionally, stacks of TEs or a single TEs can be used, as shown in FIG. 4A, to form a thermoelectric assembly 123. The thermoelectric assembly 123 can comprise a single TE or multiple TEs to provide progressive temperature gradients between or among the TEs. Additionally, precise temperature control can be achieved with the TEs, such as controlling temperature to within a tolerance of less than about one degree centigrade or less than about one-half degree centigrade. Thermoelectric assembly 123 can be used to increase the output voltage since the voltage induced over each individual thermoelectric semi-conductor node 133 is small. Upon reading the teachings of this specification, those with ordinary skill in the art will now appreciate that, under appropriate circumstances, considering issues such as changes in technology, user requirements, etc., other active heating/cooling devices for example, thermoelectric refrigerators, and thermoelectric generators yet to be developed, etc., may suffice.

FIG. 4A shows repetitive layers of thermoelectric unit layers 143 comprising thermoelectric semi-conductor nodes 133 and thermal capacitors 125, which taken together form thermoelectric assembly 123*a*. Thermoelectric semi-conductor node 133 can comprise bismuth-telluride that can be secured with electrically-conductive thermal adhesive, such as silver-filled two-component epoxy 132, as shown. Thin-film thermal epoxy 135 can fill any microscopic imperfections at the interface between each layer of thermal capacitor 125 and thin non-electrically conductive layer 131, as shown.

In an embodiment, thermoelectric semi-conductor node 133 comprises banks of electrically parallel-connected bismuth-telluride semiconductors that are in-turn electrically connected in series and interconnected to both power supply circuits and sensing/control circuits.

In some embodiment, an overall efficiency of operation of thermoelectric assembly 123*a* can be improved with the combination of adding thermal capacitance, between each electrically series-connected (and thermally connected in series) thermoelectric semi-conductor node 133, and the ability to independently control the voltage across each series-connected thermoelectric semi-conductor node 133 (at least herein embodying wherein the thermoelectric heat pump assembly 123 comprises at least one thermal capacitor 125 adapted to provide at least one thermal capacitance in thermal association with the thermoelectric heat pump assembly).

Thermal capacitor 125 can be the thermal capacitance added between each electrically series-connected (and thermally series-connected) thermoelectric semi-conductor node 133, as shown. Also, the voltage, across each electrically series-connected (and thermally series-connected) thermoelectric semi-conductor node 133, can be controlled by at least one closed-feedback loop sensory circuit. Further, the voltage, across each electrically series-connected (and thermally series-connected) thermoelectric semi-conductor node 133, can be independently controlled, as shown. Still further, the independently-controlled voltage impressed across each electrically series-connected (and thermally series-connected) thermoelectric semi-conductor node 133, can be integrated with adjacent such independently-controlled voltages, so as to ensure that under normal operational conditions, all electrically series-connected (and thermally series-connected) thermoelectric semi-conductor nodes 133 pump heat generally in the same direction, as shown. Additionally, any short-term variation in voltage, impressed across each electrically series-connected (and thermally series-connected) thermoelectric semi-conductor node 133, can be constrained to less than about 1% of the RMS value of the voltage impressed across each electrically series-connected (and thermally series-connected) thermoelectric semi-conductor node 133.

At least one thermal capacitor 125 can be about 0.64 cm (or about 0.25 in.) thick, and can be flat with parallel polished surfaces, as shown (at least embodying herein wherein such at least one thermal capacitance is user-selected to provide intended thermal association with said at least one thermoelectric device). At least one thermal capacitor 125 can have slight indentations on parallel surfaces to allow the assembler to align thermal capacitor 125 with thermoelectric semi-conductor node 133 while assembling thermoelectric assembly 123. Aluminum alloy 6061 can be used because of its lightweight, relatively high yield-strength of about 35000 psi, corrosion resistance, and excellent machinability. Aluminum alloy 6061 is resistant to stress corrosion cracking and maintains its strength within a temperature range of about −200 degree C. to about +165 degree C. Aluminum alloy 6061 is sold by McMaster-Carr as part number 9008K48. Alternately, thermal capacitor 125 can comprise copper and copper alloys, which provide needed levels of thermal conductivity, but are not as advantageous as aluminum alloys relative to structural strength and weight considerations.

Thermal capacitor 125 can be disposed between or "sandwiched" between each thermoelectric semi-conductor node 133 in thermoelectric assembly 123, as shown (at least embodying herein wherein each such sandwich layer comprises at least one set of said thermoelectric devices and at least one set of said thermal capacitors). Thermal capacitor 125 can, during normal operation, provides delayed thermal reaction time (that stores heat), and in conjunction with controlled operation of a plurality of thermoelectric semi-conductor nodes 133, may act to minimize variations in temperature swings for sensitive and perishable sensitive goods 139 (at least herein embodying wherein said intended thermal association of such at least one least one thermal capacitance is user-selected to provide increased energy efficiency of operation of said at least one thermoelectric device as compared to said energy efficiency of operation of said at least one thermoelectric device without addition of said at least one least one thermal capacitor).

Circuit board 117 can be mounted and wired to control a thermoelectric assembly 123, such as thermoelectric assembly 123*a*, 123*b*, or a variation of either. Circuit board 117 houses circuitry for connecting at least one thermocouple 124 such that at least one thermocouple 124 acts as a one-wire programmable digital thermometer to measure at least one temperature at thermocouple 124, as shown. Circuitry on circuit board 117 can also provide at least one feedback loop for control of voltage and power feeds to at least one plurality of thermoelectric semi-conductor nodes 133.

Silver-filled two-component epoxy 132 can be a thermal adhesive (at least embodying herein wherein each such sandwich layer is thermally-conductively attached to at least one other such sandwich layer; and wherein thermal conductance between essentially all such attached sandwich layers is greater than 10 watts per meter per degree centigrade). Silver-filled two-component epoxy 132 can have a specific gravity of about 3.3, can be non-reactive and can be stable over the operating temperature range of embodiment 102. Silver-filled two-component epoxy 132 can be part number EG8020 from Al Technology Inc. Upon reading the teachings of this specification, those with ordinary skill in the art will now understand that, under appropriate circumstances, considering issues such as changes in technology, user requirements, etc., other materials with a high Seebeck coefficient, such as uranium dioxide, Perovskite, and other such materials yet to be developed, etc., may suffice.

Metal-to-metal contact is advantageous for conducting maximum heat transfer. However, a minute amount of thin-film thermal epoxy 135 applied provides filling of any air pockets and may increase thermal conduction between thermal capacitor 125 and thermoelectric semi-conductor node 133 as shown in FIG. 4A. Trapped air is about 8000 times less efficient at conducting heat than aluminum; therefore, thin-film thermal epoxy 135 can be used to minimize losses in interstitial thermal conductivity, as shown. The increase in efficiency is realized because the effective contact-surface-area is maximized, thereby minimizing hot and cold spots that would normally occur on the surfaces. The uniformity increases the thermal conductivity as a direct result. Thin-film thermal epoxy 135 can be applied on both surfaces with a plastic spatula or similar device. Conductivity of thin-film thermal epoxy 135 can be poorer than the conductivity of the metals it couples; therefore it can be important to use no more than is necessary to exclude any air gaps. Upon reading the teachings of this specification, those with ordinary skill in the art will now understand that, under appropriate circumstances, considering issues such as changes in technology, user requirements, etc., other conductor enhancements, such as, for example, other thermal adhesives, material fusion, conductive fluids or other such conductor enhancers yet to be developed, etc., may suffice.

Figure 4B:
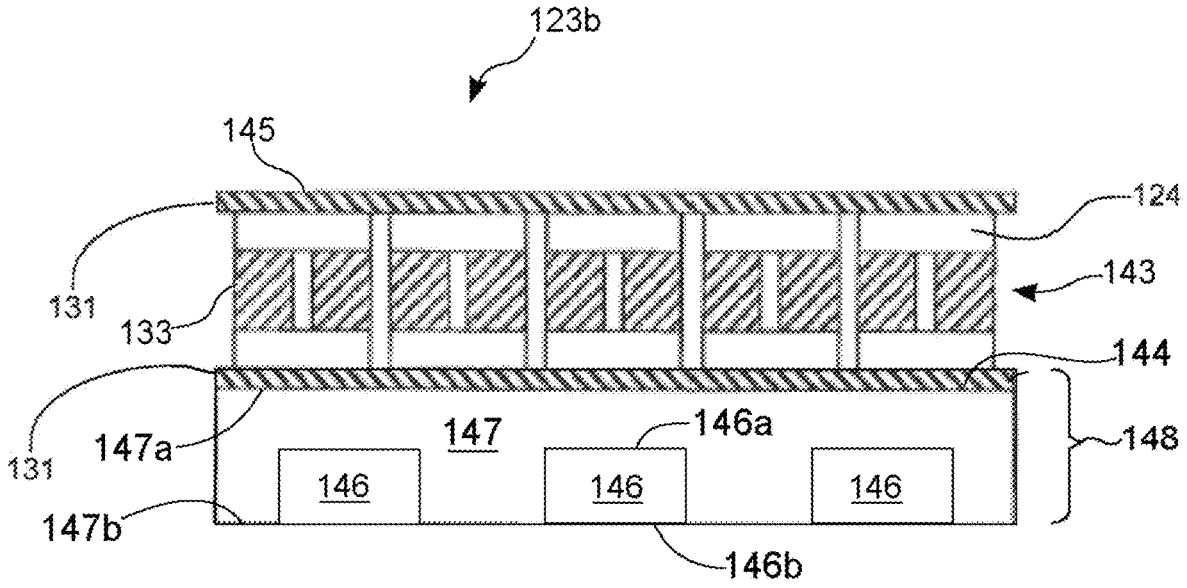

FIG. 4B shows another embodiment of thermoelectric heat pump assembly 123, thermoelectric heat pump assembly 123*b*, that can comprise one or more thermoelectric unit layers 143 capable of active use of the Peltier effect. As shown, thermoelectric unit layer 143 can have a cold side 144 and a hot side 145.

Thermoelectric unit layer 143 can be coupled to at least one resistor 146 or to one or more resistors 146 disposed within a resistor spacer block block 147, which are suitable for adding heat (Q) to the thermoelectric unit layer. Resistors 146 can be ceramic resistors, power resistors, chip style resistors such as a to-220 resistor, a to-247 resistor, or any other suitable resistor. Resistor 146 can be a passive two-terminal electrical component that implements electrical resistance as an element of a larger circuit. Resistor 146 can act to reduce flow of electrical current to produce heat Q as the flow of electrical current passes through the resistor. Resistor 146 can comprise a fixed or constant resistance, or alternatively, can comprise a variable resistance. Thermoelectric unit layer 143 can be coupled to at least one resistor 146 such that the resistor directly, or through a bonding or interface layer, can directly transfer heat produced by the resistor to cold side 144 of the thermoelectric unit layer. Alternatively, one or more resistors 146 can be coupled to a resistor spacer block 147 that is then connected to cold surface 133 of thermoelectric unit layer 143

Resistor spacer block 147 can be a thermally conductive material similar to thermal capacitor 125, described above. A surface of resistor spacer block 147 can comprise a flat or planar surface to which resistors 146 can be attached. Alternatively, a surface of resistor spacer block 147 can comprise an uneven surface comprising recesses, grooves, channels, divots, hallows, or openings in resistor spacer block 147 into which the resistors can be coupled or attached by friction, adhesives, or both, as well as by any other suitable way. As shown in FIG. 4B, resistors 146 can comprise a top surface 146*a* that contacts and is substantially coplanar with a top surface of the recess in resistor spacer block 147. Resistors 146 can also comprise a bottom surface 146*b* that can be at least partially exposed with respect to resistor spacer block 147. Taken together, resistors 146 and resistor spacer block 147 can comprise a cool sink 148, which can also be considered a source for removing coolness from vessel 121 and the cold side of thermoelectric assembly 123*b*. Stated another way, cool sink 148 can be a source of heat, adding heat to the cold side of thermoelectric assembly 123. Resistors 146 can be electrically connected in series or in parallel, and can form a source for passive heating as part of cool sink 148 by providing resistive heating that does not take advantage of active heating such as by the Peltier effect.

By forming cool sink 148 thermally and electrically coupled in series with thermoelectric assembly 123*b* (comprising one or more TEs) incubation or heating of vessel 121 can be advantageously and efficiently maintained through both active and passive heating, wherein active heating is provided through thermoelectric assembly 123 and passive heating is provided through cool sink 148. While, for convenience, thermoelectric assembly 123*b* is described as providing active heating, a person of ordinary skill in the art upon reading the disclosure will appreciate that an amount of heat (Q) can also be passively generated by thermoelectric unit layers 143 of thermoelectric assembly 123*b*, which will occur independently of heat that might result from active heating, such as through the Peltier effect.

Figure 5A:
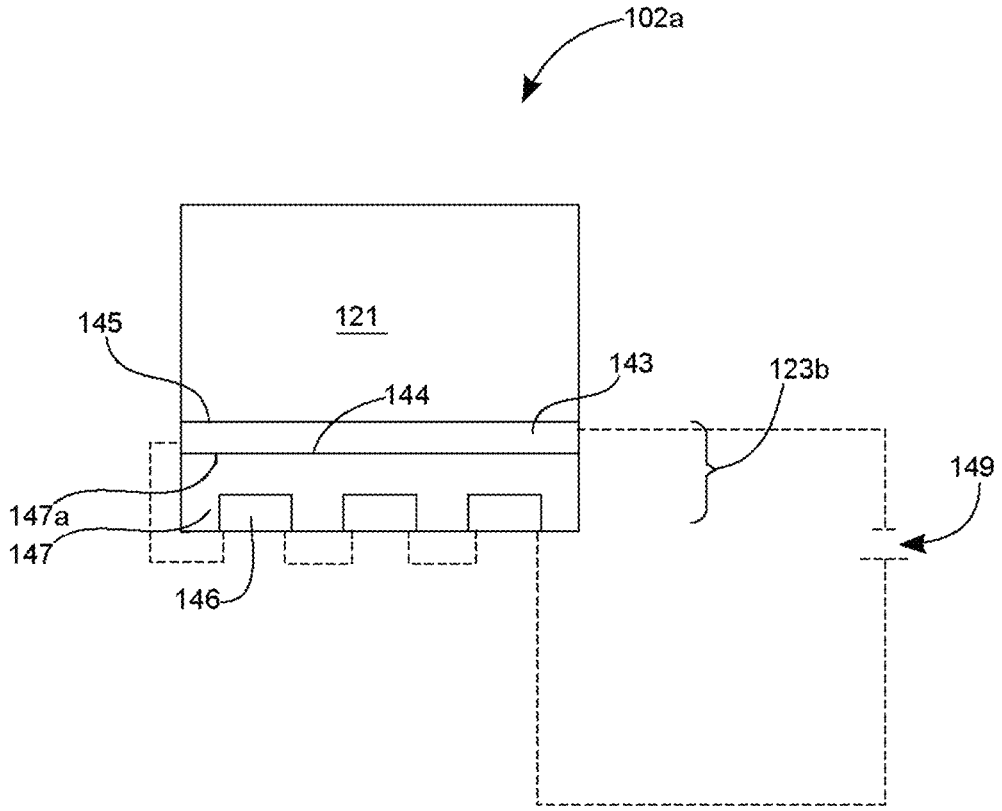
FIGS. 5A-5C show electrical schematic views, in which the thermoelectric assembly contains a cool sink, according to embodiments disclosed in accordance with FIGS. 1A and 1B.

FIG. 5A shows a non-limiting example of a schematic view of a portion of inner-workings assembly 106 of embodiment 102*a* of portable transportable active temperature controlled container 100. As discussed in relation to FIGS. 5A-5C below, introduction of a passive heating element, such as resistors 146 within cool sink 148, coupled thermally in series with thermoelectric assembly 123, can advantageously provide gains in efficiency for heating the temperature sensitive materials within the portable active temperature controlled container or iso-thermal transport and storage system 100.

Embodiment 102*a* can comprise thermoelectric assembly 123*b* similar to thermoelectric assembly 123*b* from FIG. 4B. Thermoelectric assembly 123*b* shown in FIG. 5A can comprise a single thermoelectric unit layer disposed between vessel 121 and cool sink 148. For convenience of description, vessel 121 will be referred to as a top of container 100, while thermoelectric assembly 123*b* is disposed opposite vessel 121 at a bottom of the container 100. However, other orientations are also contemplated, and all other possible orientation contemplated are not limited by the use of the terms of top and bottom herein.

Figure 5B:
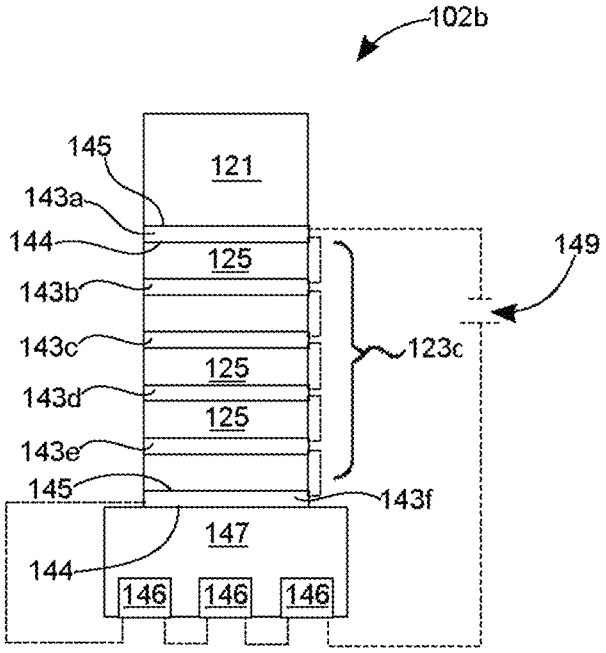
Figure 5C:
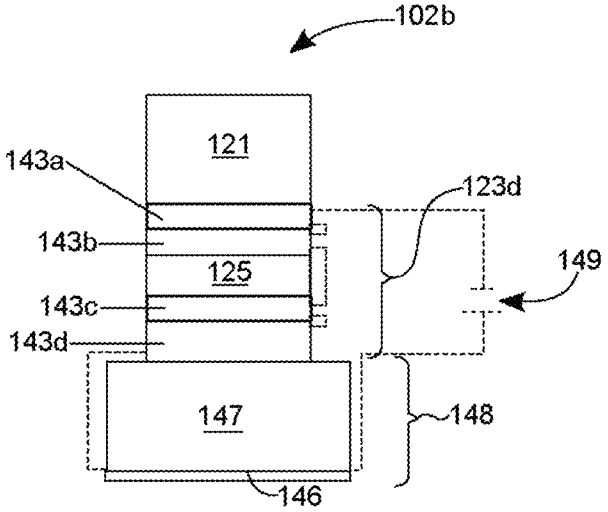

The embodiments described with respect to FIGS. 5A-5C are principally concerned with heating vessel 121 and heating the temperature sensitive goods 139 within vessel 121. FIGS. 5A-5C are principally concerned with heating vessel 121 because the temperature sensitive goods 139 including biological matter that can be transported in vessel 121 will often be transported at a temperature at or above room temperature (or about 23-26° C.), and in the case of some living biological matter, at a temperature of about 38 or 38.5° C. Furthermore, temperatures across the world for all seasons and geographies are mostly less than or equal to room temperature. Furthermore, most temperatures across the world for all seasons and geographies are less than or equal to 38 or 38.5° C. As such, temperatures encountered during shipping or transport for most classes of temperature sensitive goods 139 will be less than a temperature set point of vessel 121. As such, most of the temperature sensitive goods 139 contained within vessel 121 will require warming or heating with respect to ambient temperature conditions. As such, the special emphasis on warming vessel 121 as described with respect to FIGS. 5A-5C (and not cooling the vessel 121) can allow for the designs described herein to provide added efficiencies, lighter weight, and lower shipping costs while shipping or transporting temperature sensitive goods, which would otherwise be unavailable for other units.

Thus, for convenience of description, the top side of thermoelectric assembly 123*b* will be referred to as the hot side of the thermoelectric assembly 123*b*, and the bottom side of the thermoelectric assembly 123*b* will be referred to as the cold side, which is consistent with thermoelectric assembly 123*b* actively passing heat from the bottom of the thermoelectric assembly 123*b* to the top of the thermoelectric assembly 123*b* and into vessel 121.

Although the embodiments described with respect to FIGS. 5A-5C are principally concerned with heating vessel 121, a person of ordinary skill upon reading this disclosure will appreciate that in particular embodiments the relative descriptors of "hot side" and "cold side" could be reversed. For example, in some embodiments cool sink 148 can operate independently from thermoelectric assembly 123 so that the passive heating of cool sink 148 can be turned off or switched off, and thermoelectric assembly 123 can be used for cooling. When the cool sink 148 is switched off, current is not sent through resistors 146 so that passive heating does not occur, and operation of thermoelectric assembly 123 can be reversed so that the top side of the thermoelectric unit 143 becomes the cold side and the bottom side of the thermoelectric unit 143 becomes a hot side and cool sink 148 operates as a heat sink to remove heat from vessel 121 and to reduce a temperature of vessel 121. However, while the embodiments of FIGS. 5A-5C include the possibility of both heating and cooling as indicated above, for ease of explanation, FIGS. 5A-5C will be described in greater detail below with respect to heating and the conventions of hot and cold sides described above.

As shown in FIG. 5A, a single thermoelectric unit layer 143 can, in some embodiments, form an entirety of thermoelectric assembly 123*b*. Alternatively, as shown and discussed below with respect to FIGS. 5B and 5C, thermoelectric assembly 123 can also comprise multiple or a plurality of thermoelectric unit layer 143. As shown in FIG. 5A, a plurality of resistor 146 can be disposed in resistor spacer block 147, such that resistor 146 is not sandwiched between first and second thermoelectric unit layers 143, but instead is coupled to cold side 144 of thermoelectric unit layer 143. Hot side 145 of thermoelectric unit layer 143, which is coextensive with a top side of thermoelectric assembly 123*b*, can be adjacent to thermal isolation chamber and coupled to vessel 121.

In configurations that principally or exclusively provide heating and do not provide cooling, the fan 120 and vents 183 providing exposure between the thermoelectric assembly 123 within the container 100 and the ambient conditions outside the container 100 can be eliminated. Eliminating the fan 120 and vents 183 to ambient conditions outside the container 100 can establish greater thermal independence between ambient temperatures and a set-point temperature for the temperature sensitive goods 139 within the vessel 121. The increased thermal independence can be achieved by creating an additional temperature differential between the cold side 144 of the thermoelectric assembly 123 and ambient conditions. Thus, without the vents 183, a heating-only container 100 can have two temperature differentials. A first temperature differential between the vessel 121 (i.e. the hot side 145 of the thermoelectric assembly 123) and the cold side 144 of the thermoelectric assembly 123, and a second temperature differential between the cold side 144 of the thermoelectric assembly 123 and the ambient conditions outside the container 100. The second temperature differential between the cold side 144 of the thermoelectric assembly 123 and the ambient conditions outside the container 100 that exists for the heating-only containers 100 does not exist or is not substantial in vessels 121 that comprise vents 183 that allow airflow and convection between the cold side 144 of the thermoelectric assembly 123 and the ambient conditions outside the container 100. By establishing and preserving a second temperature differential between ambient temperatures and temperatures at a cold side 144 of the thermoelectric assembly 123, such as by additional insulation and no vents 183, the temperature differential or ΔT between the cold side 144 and the hot side 145 of the thermoelectric assembly 123 is reduced, thereby increasing efficiency and a coefficient of performance of the thermoelectric assembly 123 as described in greater detail below with respect to FIGS. 6A-D.

As shown in FIG. 5A, top portion 147*a* of resistor spacer block 147 is thermally connected to cold side 144 of thermoelectric unit layer 143, thereby adding passively generated heat from resistors 146 by thermal conduction to cold side 144 of thermoelectric unit layer 143 to decrease a temperature differential (ΔT) between cold side 144 and hot side 145 of thermoelectric assembly 123*b*. As shown in greater detail in FIGS. 6A-D, a smaller temperature differential between cold side 144 and hot side 145 of thermoelectric assembly 123*b* allows for the thermoelectric assembly to more efficiently transfer or actively pump heat from the cold side 144 to hot side 145. Thus, instead of operating the thermoelectric assembly with a temperature differential between the set point temperature of the vessel 121 and the ambient temperature, a smaller temperature differential can be maintained, which can cause the thermoelectric assembly 123 to operate more efficiently. For example, a temperature of a bottom or cold side of the thermoelectric assembly 123 can be warmer than ambient temperature outside the container, particularly if the container is being transported or shipped on a winter day, so that the temperature differential between the set point temperature of the vessel 121 and the bottom or cold side of the thermoelectric assembly 123 within the container 100 is less than it would be between the set point temperature of the ambient temperature around the vessel 121.

FIGS. 6A-D show four examples of portable active temperature controlled containers comprising cool sinks according to the embodiment shown in FIG. 5A. The thermoelectric module or thermoelectric assembly 123 comprises a single thermoelectric unit layer 143 comprising an area of 40×40 mm, 127 couples, and 1.4 ohms resistance coupled in series to cool sink 148 comprising a resistor 146 of 3.3 ohms and resistor spacer block or resistor capacitance spacer 147 comprising a thickness of 0.75 inches. More specifically, thermoelectric assembly 123 of FIG. 6A shows performance data for operation of the thermoelectric assembly 123 at a start-up condition when the thermoelectric assembly 123 has just been turned on so that no heating of vessel 121 has occurred, and a temperature differential (ΔT) between the hot and cold sides of thermoelectric assembly 123 is 0° C., or at a same temperature (e.g. 25° C. or room temperature).

As shown in FIG. 6A, under initial conditions when ΔT between hot and cold sides of thermoelectric assembly 123 is 0° C., thermoelectric unit layer 143 provides active heating by adding 15.58 watts of power (Q add) while consuming 5.30 watts (power) so that a coefficient of performance (COP) or a ratio of: energy used (power in watts)/heat added (Q add in watts) is approximately equal to 3.1283 (COP). Thus, the efficiency of embodiments 102/102*a*/102*b* is more than three times greater than the performance of a simple non-active or passive resistive heating element that will have a COP of about 1 that produces a same amount of heat as is applied in power across the resistor 146.

Thermoelectric assembly 123 of FIG. 6B shows performance data for operation of the thermoelectric assembly 123 at a start-up condition when the thermoelectric assembly 123 has just been turned on so that no heating of vessel 121 has occurred, and a temperature differential (ΔT) between the hot and cold sides of thermoelectric assembly 123 is 0° C., or at a same temperature (e.g. 25° C. or room temperature).

FIG. 6B shows operating conditions after an initial start-up period in which ΔT between hot and cold sides of thermoelectric assembly 123 is 1° C., which could occur for example when thermoelectric assembly 123 is operating at steady state with a room temperature ambient environment. Under these conditions, thermoelectric unit layer 143 provides active heating by adding 15.36 watts of power (Q add) while consuming 5.25 watts (power) so that the COP is approximately equal to 2.9257. Thus, the efficiency of embodiments 102/102*a*/102*b* is just less than three times greater than the performance of a simple non-active or passive resistive heating element that will have a COP of about 1. The difference between the COP in FIG. 6A and FIG. 6B is indicative of the fact that the COP of the portable active temperature controlled container 100 will be changing during operation and changing environmental conditions.

FIG. 6B also shows that the Q add or the heat actively added by thermoelectric assembly 123 is at 15.36 watts, which would be more heat than necessary in maintaining the temperature set point within vessel 121 during constant operation. As such, thermoelectric assembly 123, and cool sink 148 can operate intermittently, such as by operating on a pulse width modulation (PWM), or by alternately turning on and off. Any ratio of on/off time or any PWM signal can be used according to the needs of the system. As a non-limiting example, in some cases a square wave PWM signal can operate thermoelectric assembly 123 and cool sink 148 with a duty cycle of about 10% to supply about 1.5 watts of Q add, or a duty cycle of about 3% to supply about 0.5 watts of Q add, or for any other suitable amount of time. Additionally, the on off intervals can be for any length of time, including on times in the thousands of seconds or for 30 or more seconds and up to a minute, or for any other amount of time.

Thermoelectric assembly 123 of FIG. 6C shows performance data for operation of the thermoelectric assembly 123 during steady-state operation in cold conditions, such as on a winter day, in which a temperature differential (ΔT) between the hot and cold sides of thermoelectric assembly 123 is 5° C. after 4.9 watts of power have been supplied as passive heating by the resistor 146.

Under the conditions present in FIG. 6C, thermoelectric unit layer 143 provides active heating by adding 11.76 watts of power (Q add) while consuming 4.9 watts (power) so that the COP is approximately equal to 2.4000. Thus, the efficiency of embodiments 102/102*a*/102*b* is about two-and-one-half times greater than the performance of a simple non-active or passive resistive heating element that will have a COP of about 1. Thus, as the temperature differential between the hot side and the cold side of thermoelectric assembly 123 increases, the efficiency or COP of thermoelectric assembly 123 decreases because the temperature differential and COP of thermoelectric assembly 123 are inversely related.

FIG. 6C also shows that the Q add or the heat actively added by thermoelectric assembly 123 is at 11.76 watts, which would be more heat than necessary in maintaining the temperature set point within vessel 121 during constant operation. As such, thermoelectric assembly 123, and cool sink 148 can operate intermittently, such as by operating on a pulse width modulation (PWM), or by alternately turning on and off so that the heat is being added to vessel 121 about 30% of the time or with a 30% duty cycle for the given conditions.

Thermoelectric assembly 123 of FIG. 6D shows performance data for operation of the thermoelectric assembly 123 before steady-state operation or during steady state operations in very cold conditions (and perhaps with insufficient insulation), such as on a winter day, in which a temperature differential (ΔT) between the hot and cold sides of thermoelectric assembly 123 is 11.8° C. after 4.49 watts of power have been supplied as passive heating by the resistor 146.

Under the conditions present in FIG. 6D, thermoelectric unit layer 143 provides active heating by adding 6.21 watts of power (Q add) while consuming 4.49 watts (power) so that the COP is approximately equal to 1.3828. Thus, the efficiency of embodiments 102/102*a*/102*b* is about 130% greater than the performance of a simple non-active or passive resistive heating element that will have a COP of about 1. Thus, as the temperature differential between the hot side and the cold side of thermoelectric assembly 123 increases, the efficiency or COP of thermoelectric assembly 123 decreases because the temperature differential and COP of thermoelectric assembly 123 are inversely related. As the ΔT between the hot and cold sides of thermoelectric unit layer 143 or thermoelectric assembly 123 approach about 12 or 13° C., the COP approaches 1, so that active heating is no more efficient than passive or resistive heating, and that beyond the 12-13° C. AT (or with ΔT greater than about 12-13° C.) active heating becomes less efficient than passive heating. As the temperature ramp up period moves to a steady state condition, the temperature differential between the hot and cold sides will decrease and the COP will increase to operate at a point similar to that shown in FIG. 3.

FIG. 6D also shows that the Q add or the heat actively added by thermoelectric assembly 123 is 6.21 watts, all of which is necessary in maintaining the temperature set point within vessel 121 during constant operation. As such, thermoelectric assembly 123, and cool sink 148 would operate continuously, with a 100% duty cycle.

Therefore, for the conditions presented in FIGS. 6A-D, a ΔT less than about 12-13° C. is maintained with passive resistive heating that allows for active heating by thermoelectric assembly 123 with a COP in a range of about 100-400%, with the COP being near 100% or in a range of 100-150% a small portion of the time and with most of the operation occurring at or near 200-300% COP to provide better than resistive heating. By maintaining a COP greater than or equal to 100% the combined active and passive heating operates more efficiently than passive resistive heating.

As illustrated by the data in FIGS. 6A-D, a ratio of the resistance of thermoelectric assembly 123 and resistor(s) 146 is about 1:2. As such, thermoelectric assembly 123 comprises about one-third (⅓) of an overall resistance for the portable active temperature controlled containers 100 while the passive resistors 146 will have about two-thirds (⅔) of total circuit resistance. The approximate ranges of total resistance can vary in that a resistance of thermoelectric assembly 123 or thermoelectric unit layer 143 can be temperature sensitive and changes by about 25% during temperature cycling so that a resistance ratio might be in a range of about 1-2, or about 1.4-1.67, and a resistance of the thermoelectric assembly 123 or thermoelectric unit layer 143 might vary by about 1-2 ohms, or by about 1.45 ohms during temperature cycling. While resistance of the passive resistors 146 might also change during temperature cycling, the passive resistors 146 are often less susceptible to temperature induced changes in resistance, varying in resistance by less than or equal to about 1-2%.

Accordingly, the container 100 described herein presents a number of advantages including a container 100 comprising a weight of as little as about 7.5 lbs. that can provide about 48-60 hours of operation on single battery charge, whereas units previously known in the art would weight in a range of about 13-16 lbs. and operate for about 30 hours. As such, the container 100 described herein can operate for about twice the time and weigh about half as much as those units used conventionally.

FIG. 5B similar to FIG. 5A, shows a schematic view of a portion of inner-workings assembly 106 of embodiment 102*b* of iso-thermal transport and storage system or portable active temperature controlled container 100. Embodiment 102*b* comprises thermoelectric assembly 123*c* similar to thermoelectric assembly 123*b* from FIG. 5A. Thermoelectric assembly 123*c* in FIG. 5B comprises a plurality of thermoelectric unit layers 143*a*-143*f* interleaved with a plurality of thermal capacitors 125.

FIG. 5B illustrates a non-limiting embodiment in which a passive heating element, such as resistors 146 can be coupled to a resistor spacer block 147 to form a cool sink 148, as described above with respect to FIG. 5A. FIG. 5B differs from FIG. 5A by including a plurality of thermoelectric unit layers 143 interleaved with a plurality of thermal capacitors 125 disposed between vessel 121 and cool sink 148, wherein thermoelectric unit layers 143*a-f* can be connected in series, either thermally, electrically, or both. As such, the portable active temperature controlled containers 100 shown in FIG. 5B can advantageously provide gains in efficiency for heating the temperature sensitive materials 139 within vessel 121 as described above with respect to FIG. 5A.

FIG. 5C, similar to FIGS. 5A and 5B, shows a schematic view of a portion of inner-workings assembly 106 of embodiment 102*b* of iso-thermal transport and storage system or portable active temperature controlled container 100. Embodiment 102*b* can comprise thermoelectric assembly 123*d* similar to thermoelectric assemblies 123*b* and 123*c* from FIGS. 5A and 5B, respectively. Thermoelectric assembly 123*d* in FIG. 5C comprises a plurality of thermoelectric unit layer 143*a*-143*d* disposed around thermal capacitor 125 such that some thermoelectric unit layers 143 are adjacent each other, while others are separated by the thermal capacitor 125.

FIG. 5C illustrates a non-limiting embodiment in which a passive heating elements, such a resistors 146 can be coupled to a resistor spacer block 147 to form a cool sink 148, as described above with respect to FIG. 5A. The portable active temperature controlled container 100 shown in FIG. 5C can advantageously provide gains in efficiency for heating the temperature sensitive materials 139 within vessel 121 as described above with respect to FIG. 5A. Thus, as shown in FIG. 5C, thermoelectric unit layer 143 can be stacked with or without thermal capacitors 125. Additionally, the inclusion of one or more resistors 146 provides for improved heating efficiency of the active heating provided by the thermoelectric unit layers 143 (with or without thermal capacitor(s) 125), and are advantageously disposed at a bottom of thermoelectric assembly 123*d*.

FIG. 5C, like FIGS. 5A-5C, also shows that portable active temperature controlled containers 100 comprising cool sinks 148 can provide an efficient system with a mix of passive and active heating without a fan 120 and without vents 183 to an exterior of the container 100 as is currently practiced for conventional heating and cooling containers.

In the foregoing specification, various embodiments have been described. It will, however, be evident that various modifications and changes may be made thereto without departing from the broader spirit and scope set forth in the appended claims. The specification and drawings are, accordingly, to be regarded in an illustrative sense rather than a restrictive sense.

What is claimed is:

1. A portable active temperature controlled container, comprising:

a vessel for holding temperature sensitive goods;

a thermoelectric assembly comprising at least one thermoelectric unit layer coupled to the vessel;

a thermally conductive resistor spacer block coupled to the thermoelectric assembly opposite the vessel such that the thermoelectric assembly is disposed between the thermally conductive resistor spacer block and the vessel; and at least one resistor coupled to the resistor spacer block.

2. The portable active temperature controlled container of claim 1, wherein the at least one resistor is electrically coupled in series to the thermoelectric assembly.

3. The portable active temperature controlled container of claim 1, wherein the at least one resistor is disposed within a recess formed in the resistor spacer block.

4. The portable active temperature controlled container of claim 1, wherein the temperature differential between a temperature of a cold side and a hot side of the thermoelectric assembly is less than or equal to 13° C.

5. The portable active temperature controlled container of claim 1, wherein a resistance of the thermoelectric assembly is in a range of 0.35-0.65 times a resistance of the at least one resistor.

6. The portable active temperature controlled container of claim 1, wherein a resistance of the thermoelectric assembly is in a range of 0.25-0.50 times a resistance of the at least one resistor.

7. The portable active temperature controlled container of claim 1, wherein the thermoelectric assembly is configured to operate with a coefficient of performance greater than or equal to 100%.

8. The portable active temperature controlled container of claim 7, wherein the thermoelectric assembly is configured to operate with a coefficient of performance in a range of 150-300% during at least 80 percent of operation.

9. The portable active temperature controlled container of claim 1, wherein the portable active temperature controlled container is formed without a fan.

10. The portable active temperature controlled container of claim 9, wherein the portable active temperature controlled container is formed without a vent between the thermoelectric assembly and an exterior of the portable active temperature controlled container.

11. The portable active temperature controlled container of claim 1, wherein the thermoelectric assembly is adapted to control a temperature of the temperature-sensitive goods within the vessel to within plus or minus 0.3° C. of a target temperature of 38.5° C.

12. A portable active temperature controlled container, comprising:

a vessel for holding temperature sensitive goods;

a thermoelectric assembly comprising at least one thermoelectric unit layer coupled to the vessel, the thermoelectric assembly being configured to operate with a coefficient of performance greater than or equal to 100%;

a thermally conductive resistor spacer block coupled to the thermoelectric assembly opposite the vessel such that the thermoelectric assembly is disposed between the thermally conductive resistor spacer block and the vessel; and at least one resistor coupled to the resistor spacer block.

13. The portable active temperature controlled container of claim 12, wherein the temperature sensitive goods comprise: embryos, oocytes, cell cultures, tissue cultures, chondrocytes, nucleic acids, bodily fluids, bovine semen, organs, plant tissues, pharmaceuticals, vaccines, and chemicals.

14. The portable active temperature controlled container of claim 12, wherein the resistor spacer block comprises aluminum, aluminum alloy, copper, or copper alloy and conducts heat generated by the at least one resistor towards a cold side of the at least one thermoelectric unit layer.

15. A portable active temperature controlled container, comprising:

a vessel for holding temperature sensitive goods;

a thermoelectric assembly comprising at least one thermoelectric unit layer coupled to the vessel;

a thermally conductive resistor spacer block coupled to the thermoelectric assembly opposite the vessel such that the thermoelectric assembly is disposed between the thermally conductive resistor spacer block and the vessel; and at least one resistor coupled to the resistor spacer block, wherein a resistance of the thermoelectric assembly is in a range of 0.35-0.65 times a resistance of the at least one resistor.

16. The portable active temperature controlled container of claim 15, wherein the temperature differential between a temperature of a cold side and a hot side of the thermoelectric assembly is less than or equal to 13° C.

17. The portable active temperature controlled container of claim 16, wherein the at least one resistor is electrically coupled in series to the thermoelectric assembly.

18. The portable active temperature controlled container of claim 16, wherein the at least one resistor is disposed within a recess formed in the resistor spacer block.

19. The portable active temperature controlled container of claim 16, wherein the portable active temperature controlled container is formed without a fan.

20. A method of safely transporting temperature sensitive goods at a selected temperature profile during transport using the portable active temperature controlled container of claim 15, comprising:

placing the temperature sensitive goods in the vessel within the portable active temperature controlled container, the portable active temperature controlled container adapted to thermally isolate the temperature sensitive goods from an outside environment; and controlling a temperature of the portable active temperature controlled container by activating the Peltier effect of the thermoelectric assembly, wherein the thermoelectric assembly comprises a stack of at least two thermoelectric modules.

* * * * *